US008821131B2

(12) United States Patent
Yokota et al.

(10) Patent No.: US 8,821,131 B2
(45) Date of Patent: Sep. 2, 2014

(54) AIR COMPRESSOR

(75) Inventors: Tomoyoshi Yokota, Ibaraki (JP); Seiichi Kodato, Ibaraki (JP); Kenichi Matsunaga, Ibaraki (JP); Kazuhiro Segawa, Ibaraki (JP); Naoto Ichihashi, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 764 days.

(21) Appl. No.: 12/365,419

(22) Filed: Feb. 4, 2009

(65) Prior Publication Data

US 2009/0194177 A1 Aug. 6, 2009

(30) Foreign Application Priority Data

Feb. 5, 2008 (JP) ..... P2008-024810
Jul. 29, 2008 (JP) ..... P2008-194748

(51) Int. Cl.
*F04B 23/14* (2006.01)

(52) U.S. Cl.
USPC ..... 417/201; 417/415; 137/565.18; 310/63

(58) Field of Classification Search
CPC ..... F04B 35/04; F04B 35/06; F04B 39/066; F04B 49/022; F04D 25/08; F04D 25/082; F04D 25/16; F04D 25/166; H02K 9/04; H02K 9/06
USPC ..... 417/415, 201, 234; 137/565.18, 899.4; 310/62, 63
See application file for complete search history.

(56) References Cited

U.S. PATENT DOCUMENTS 3,229,896 A * 1/1966 Levy ..... 417/423.8
4,190,402 A * 2/1980 Meece et al. ..... 417/415
4,554,472 A * 11/1985 Kumatani ..... 310/62

(Continued)

FOREIGN PATENT DOCUMENTS

JP 58175180 U 11/1983
JP 2000283046 A * 10/2000 ..... F04B 41/02

(Continued)

OTHER PUBLICATIONS

Machine translation for JP 20033254247A obtaind on Oct. 4, 2012 from JPO website, JP 2003254247 A—Author: Kanemoto, Yoshiyuki, Title: Air Compressor, Publisher: JPO all pages; the machine translation is included in the attached copy of Foreign document JP 2003254247 A.*

(Continued)

*Primary Examiner* — Devon Kramer
*Assistant Examiner* — Joseph Herrmann
(74) *Attorney, Agent, or Firm* — McDermott Will & Emery LLP

(57) ABSTRACT

According to the invention, an air compressor includes: one pair of air tanks arranged parallel to each other by being separated from each other in a constant interval, for storing thereinto compressed air; a compressing unit that compresses air sucked from an external space so as to supply the compressed air to the air tanks; and a motor coupled to the compressing unit so as to drive the compressing unit, while the motor and the compressing unit are arranged above the one pair of air tanks; wherein: a cooling fan that generates cooling wind is provided on one end of a rotation shaft of the motor; and a control circuit unit that drives the motor is arranged above the one pair of air tanks and at a position which is overlapped with an axial direction projection area of the cooling fan.

17 Claims, 14 Drawing Sheets

(56) References Cited

U.S. PATENT DOCUMENTS

| | | | | |
|---|---|---|---|---|
| 6,011,331 | A * | 1/2000 | Gierer et al. | 310/58 |
| 6,364,632 | B1 * | 4/2002 | Cromm et al. | 417/372 |
| 6,431,839 | B2 * | 8/2002 | Gruber et al. | 417/234 |
| 6,474,954 | B1 * | 11/2002 | Bell et al. | 417/201 |
| 6,488,475 | B2 * | 12/2002 | Murata et al. | 417/32 |
| 6,551,066 | B2 * | 4/2003 | Saylor et al. | 417/44.2 |
| 2007/0023421 | A1 * | 2/2007 | Kitamura et al. | 219/623 |
| 2007/0273221 | A1 * | 11/2007 | Kinoshita et al. | 310/58 |
| 2008/0112823 | A1 * | 5/2008 | Yoshida et al. | 417/410.1 |
| 2008/0134997 | A1 * | 6/2008 | Ito et al. | 123/41.65 |
| 2008/0181794 | A1 * | 7/2008 | Steinfels et al. | 417/234 |
| 2009/0016904 | A1 * | 1/2009 | Mannen et al. | 417/279 |

FOREIGN PATENT DOCUMENTS

| | | | | |
|---|---|---|---|---|
| JP | 2003-254247 | A | 9/2003 | |
| JP | 2003254247 | A * | 9/2003 | F04B 49/06 |
| JP | 2004-218514 | A | 8/2004 | |
| JP | 2004-300996 | | 10/2004 | |
| JP | 2006-132482 | A | 5/2006 | |
| JP | 2006-188954 | | 7/2006 | |

OTHER PUBLICATIONS

Japanese Office Action, and English translation thereof, issued in Japanese Patent Application No. 2008-024810 dated Jul. 18, 2012.

Japanese Office Action, and English translation thereof, issued in Japanese Patent No. 2008-194748 dated Aug. 14, 2012.

Japanese Office Action issued Dec. 25, 2012 in Japanese Patent Application No. 2008-024810.

* cited by examiner

AIR COMPRESSOR

BACKGROUND

1. Field

The present invention is related to an air compressor suitable for producing compressed air which is required in order to drive, for instance, a pneumatic tool. More specifically, the present invention is directed to such an air compressor capable of cooling heat generating units such as a circuit board, a motor, a compressor, and the like in a higher efficiency, while the circuit board contains inverter control means.

The present invention is also related to an air compressor equipped with a main body cover and an operation panel.

2. Description of the Related Art

For instance, in construction sites, pneumatic tools for driving nails and screws into timber by utilizing pressure of compressed air are widely utilized. In general, air compressors for driving pneumatic tools have been constructed as follows: That is, rotary motion of rotation power shafts of driving units of motors and the like is converted into reciprocating motion of pistons provided within cylinders via crank shafts of compressed air generating units, and then, air sucked from air intake valves of the cylinders is compressed by the reciprocating motion of the pistons. The air compressed within the cylinders is emitted from exhaust valves of the cylinders via pipes to air tanks, and then, the compressed air is stored in the air tanks.

In such a case that an air compressor is arranged by two sets of air tanks, the air compressor contains two pieces of substantially cylindrical-shaped air tanks, and a frame which couples these two air tanks to each other by being separated from each other by a constant distance, while these two air tanks are installed in a parallel manner. Both a driving unit and a compressing unit (compressed air generating unit) are set on the upper side of the frame. Air compressed by the compressing unit is emitted to one of the two air tanks. While these two air tanks are communicated with each other via a pipe, since the compressed air is supplied from one air tank via the pipe to the other air tank, pressure within one air tank is kept equal to pressure within the other air tank. While pneumatic tools such as nailing machines are employed in order to utilize the compressed air which is stored in this air tank, high pressure of the compressed air is adjusted to proper pressure by a pressure reducing valve mounted on the air tank, and then, the pressure-controlled compressed air is supplied via an air hose to the pneumatic tools and the like. This sort of air compressors are disclosed in, for instance, JP-A-2006-188954.

The air compressor of JP-A-2006-188954 is equipped with an air tank, a motor unit, and a main body cover which covers a compressing unit. Then, electric power is supplied to a motor for driving the compressing unit by detecting a rotation position of a rotor of the motor, and also, by controlling both a current and a voltage, which are applied to a stator coil of the motor, in response to the detection signal of the rotation position. Very recently, in air compressors, inverter control means are widely used in order to drive motors in higher efficiencies, so that power consumption can be reduced.

Circuits for controlling inverters are arranged by employing semiconductor switching elements and other electronic components. While the semiconductor switching elements are under operation, heat generations from the semiconductor switching elements are large, so that these semiconductor switching elements are required to be cooled. If the semiconductor switching elements are operated under insufficient cooling conditions, then these switching elements are destroyed due to heat generations, so that control operations for motors can be no longer carried out by the inverter control circuits. As a consequence, in general, the following protection means is conducted. That is, while protection circuits are provided in control circuit unit 5, when temperatures of these electronic components are reached to predetermined temperatures, the protection circuits interrupt the supply of electric power to the motors so as to prevent destruction of the semiconductor switching elements. If the supply of the electric power is interrupted, then there is such a demerit that compressing operations of the air compressors are stopped every time the supply of the electric power is interrupted.

Very recently, while such pneumatic tools as not only nailing machines, but also screw drivers are widely utilized which are driven by using compressed air, operation frequencies of air compressors are increased in connection with increasing of consumption amounts of the compressed air. As a consequence, in air compressors with employment of inverter control means, the below-mentioned aspects are expected. That is, it is desirable to prevent overheat phenomena of inverter control circuits, and also desirable to reduce frequencies at which the operations of the air compressors are stopped, since protection circuits are operated.

In a conventional technique, an inverter control circuit unit equipped with heat generating components is stored in a storage case made of an aluminum material, or the like, which has a better thermal conducting characteristic, in such a manner that the heat generating components are closely fitted to the case. Then, the inverter control circuit unit is arranged between one pair of air tanks and below at least any one of a motor and a compressor; a portion of air flows generated by a cooling fan mounted on a compressor-sided end portion of a rotation shaft of the motor is blown to a wind duct so as to cool the heat generating components; and the wind duct is surrounded so as to be constructed by the air tanks, the compressor, the motor, and the control circuit unit.

However, when the conventional air compressor is operated in either a continuous manner or an interruption manner, temperatures at the motor unit, the compressing unit, and the air tank unit are increased due to heat generations caused by apparently the control circuit and copper losses of the stator coil of the motor, heat generations caused by friction losses of ball bearings, piston rings, and the like of the compressing unit, and further, compressing friction heat generated when air is compressed. As a result, the interior portion of the cooling-purpose air duct is brought into a high temperature condition; even when outside air is taken into the cooling-purpose air duct, the temperature at the cooling air itself is increased; and thus, the circuit elements of the control apparatus are cooled by utilizing such an air brought into the high temperature condition; so that the cooling effect is considerably lowered. If the air compressor is driven under such a poor cooling condition, then the temperature at the control circuit elements are eventually reached to a predetermined high temperature. Accordingly, there are some possibilities that the protection unit is operated, so that the operation of the air compressor is stopped.

Also, in addition to such a covering condition that the heat generating components are covered by the storage case, since the control circuit is arranged between one pair of the air tanks and located below at least any one of the motor and the compressor, as to the cooling fan mounted on the side of the compressor, such an axial flow type cooling fan must be necessarily set which is larger than the outer dimensions of the compressing unit and of the motor in order that the temperature increase occurred inside the main body cover is suppressed, and further, a sufficiently large amount of the cooling wind is blown through the wind duct formed between one pair of the air tanks. Since there is lack of the air exhausting ports for exhausting the heat stored in the interior portion of the main body cover, the temperature within the main cover is increased. As a consequence, such a large-sized axial flow type cooling fan may give a harmful influence when the main body of the compressor is designed to become compact.

Moreover, in order to avoid the above-described harmful influence, if a large-sized cooling fan is employed so as to below cooling wind through the entire interior portion of the main body cover, then the air streams are disturbed by concave and convex portions such as the compressor and the motor unit. As a result, the cooling wind cannot be exhausted in a higher efficiency outside the air compressor, which may cause a factor for increasing the temperature at the interior portion of the main body cover.

Additionally, for instance, in construction sites, pneumatic tools for driving nails and screws into timber by utilizing pressure of compressed air are utilized. Normally, compressed air which constitutes power of pneumatic tools is supplied from air compressors via air hoses to the pneumatic tools, and then, the pneumatic tools convert the supplied compressed air to power so as to drive nails and screws.

As disclosed in, for instance, JP-A-2004-300996, this sort of air compressor is constituted by an electric motor, a compressing unit, an air tank, a driving control apparatus, a fan, and a main body cover for covering these structural elements. The compressing unit is driven by the electric motor so as to suck outside air and compress the sucked outside air. The air tank stores thereinto the compressed air produced from the compressing unit. The driving control apparatus drives the electric motor. The fan cools the electric motor and the compressing unit, which generate heat by being operated.

Generally speaking, while this sort of air compressor is equipped with a pressures sensor within the air tank, the air compressor controls driving conditions thereof based upon an output signal (detected pressure) of the pressure sensor. For example, the driving control apparatus of the air compressor performs the below-mentioned control operations in order to maintain a proper amount of compressed air: That is, if compressed air stored in the air tank is decreased since the compressed air is consumed by works and thereafter detected pressure becomes lower than, or equal to a predetermined reference value (re-initiating pressure), then the electric motor is re-initiated so as to re-fill compressed air. When pressure within the air tank is returned to such a pressure value higher than, or equal to another reference value (stopping pressure), the driving control apparatus stops the electric motor.

Also, in addition to the above-explained control operation of the driving conditions of the air compressor, rotation numbers of the electric motor are changed in response to detection values of the pressure sensor so as to reduce noise; and since pressure changes occurred in the air tank are monitored, work conditions of the pneumatic tools are predicted so as to automatically change a setting value of the re-initiating pressure and the rotation number of the electric motor.

Moreover, while a power supply voltage, a power supply current, a rotation number under normal operation condition, and/or a condition as to pressure variations within the air tank are previously stored in the driving control unit, the driving control apparatus judges an abnormal condition, and notifies an occurrence of the abnormal condition from an operation panel.

As previously described, the operation panel may play an important role as a user interface. As indicated in FIG. 14, an operation panel 99 is directly fixed on an upper plane of a main body cover 8 in order to improve operable characteristics and visual recognizable characteristics. The main body cover 8 is provided in order to avoid that operators directly touch both a compressing unit 3 and an motor unit 2, which generate heat, and also, in order to form air ducts of cooling winds which are produced from cooling fans 11 and 12. As a consequence, resin materials are utilized which have superior forming characteristics and which can hardly transfer heat.

Since the main body cover 8 of the conventional air compressor 1 exemplified in FIG. 14 is formed by the resin material, the main body cover 8 has a low rigidness. Moreover, since fixed portions with respect to the rigid body are small, the main body cover 8 may be easily vibrated. As a consequence, the main body cover 8 may also be also vibrated and therefor may produce noises, since vibrations are generated when the compressing unit 1 is operated. As a result, the vibrations of the main body cover 8 may constitute one of factors which deteriorate operation environments. Moreover, there are some possibilities that large vibrations may be produced at a portion located in the vicinity of the uppermost portion of the main body cover 8, in which the operation panel 99 is arranged. Due to the above-described vibrations, there are some possibilities that disconnections may occur in a connection portion between a switch of the operation panel 99 and a power supply cable 901 connected to a power supply cord 50, and another connection portion between the switch and a signal cable 902 due to aging effects, while the operation panel 99 is mounted on the main body cover 8 in an integral body. The signal cable 902 is employed in order to transfer signals between the own signal cable 902 and a control circuit unit 5.

In addition, in such a case that the conventional air compressor 1 is assembled in production stages, or is overhauled, when the main body cover 8 is mounted on the main body of the conventional air compressor 1, since the power supply cable 901 and the signal cable 902 are tensed which are elongated from the operation panel 99, there is such a risk that contact failures of connector portions may occur. In order to prevent the occurrence of such contact failures, cable lengths of the power supply cable 901 and the signal cable 902 must be sufficiently prolonged, so that cables having extra lengths are necessarily required. In addition, in such a case that operation failures are confirmed when operations of the conventional air compressor 1 are finally confirmed after the main body cover 8 is mounted, this mounted main body cover 8 must be dismounted. Increasing of such material cost and also increasing of managing steps may constitute a factor for increasing the manufacturing cost of the conventional air compressor 1.

SUMMARY OF THE INVENTION

As a consequence, a major object of the present invention is to provide an air compressor equipped with a motor, a compressor, and a control circuit for controlling rotations of the motor, capable of cooling a heat generating portion in a higher efficiency.

Another object of the present invention is to provide an air compressor capable of cooling an electronic component such as inverter control means in a higher efficiency, which generates a large amount of heat and is contained in the control circuit, since a setting place for setting the control circuit for controlling the rotations of the motor is properly selected.

A further object of the present invention is to provide an air compressor capable of smoothing air flows within a main body cover.

The above-described objects, other objects, and a novel feature of the present invention may become apparent from descriptions and drawings of the below-mentioned specification.

A typical feature within inventive ideas disclosed in the present invention will now be described as follows:

In an air compressor including: one pair of air tanks arranged parallel to each other by being separated from each other in a constant interval, for storing thereinto compressed air; a compressing unit for compressing air sucked from an external space so as to supply the compressed air to the air tanks; and a motor coupled to the compressing unit so as to drive the compressing unit, while the motor and the compressing unit are arranged above the one pair of air tanks; a cooling fan for generating cooling wind is provided on one end of a rotation shaft of the motor; and a control circuit unit for driving the motor is arranged above the one pair of air tanks and at a position which is overlapped with an axial direction projection area of the cooling fan. The above-described control circuit unit contains a storage case for storing thereinto a circuit board, and is arranged in such a manner that either a portion or an overall portion of the storage case is involved in the axial direction projection area of the cooling fan. In this case, the axial direction projection area of the cooling fan implies either an area or a portion, which is involved when an outer diameter of the cooling fan, or an outer diameter of a housing for storing therein the cooling fan is projected along a rotation axial direction. Generally speaking, the above-described axial direction projection area is substantially coincident with an air flow generated by the cooling fan, by which a cooing effect achieved by the cooling fan may be influenced in the highest degree. Also, the space located above the air tanks has the following concept: This space implies not only such a space located above the uppermost portion of the air tanks, but also a space located higher than axial lines of the air tanks along longitudinal directions thereof, or a space located higher than a frame which is arranged parallel to the air tanks and couples the air tanks to each other.

The storage case is such a case made of a material having a superior thermal conducting characteristic, for example, aluminum, and corresponds to a case having a substantially rectangular parallelepiped shape, all planes of which are closed, or at least one plane of which is opened. In such a case that the storage case has the opened planes, the storage case is arranged along either a longitudinal direction or a lateral direction, while one of these opened planes is directed to the cooling fan.

A semi-spherical and cylindrical-shaped fan guide is provided on one end side of a housing of the motor, while the fan guide is to guide cooling wind of the cooling fan to a stator coil portion. Cooling wind sucked into an interior portion of the fan guide is conducted to a stator coil by this fan guide in a higher efficiency, and then, the conducted cooling wind is exhausted from either a side portion or a rear end portion of the housing for storing the motor. It is preferable that a diameter of an air sucking port of the fan guide is smaller than a width of the opened plane of the storage case, or a width of the storage case itself. In this case, it is preferable that the fan guide is arranged in such a manner that the air sucking port is located within the storage case.

Although it is preferable that the cooling fan is a centrifugal fan which is provided inside the fan guide, even when other suction fans are available, these suction fans may be similarly employed. Alternatively, an air ejecting port may be provided in an outer circumferential portion of the fan guide, while the air ejecting port is to exhaust a portion of the sucked cooling wind to the external space without conducting the sucked cooling wind to the stator coil portion of the motor.

A main body cover having wind windows capable of passing therethrough air, which are formed in a front plane and a side plane of the main body cover, is provided in the air compressor, while the main body cover covers at least a portion of one pair of the air tanks, the compressing unit, and the motor. An air flow generated by the cooling fan is sucked from the wind window (slit) of the front plane of the main body cover, the sucked air flow passes through the peripheral portion of the control circuit unit installed on the upper stream side of the air flow generated by the cooling fan, and then, is entered in the interior portion of the fan guide. The entered air flow passes through the interior portion of the motor, and then, is exhausted from either the side portion or the rear end portion of the motor to the external space of the motor. Thereafter, the exhausted air flow is exhausted from the wind window of the side plane of the main body cover to the external space.

It should be understood that while the control circuit unit is positioned above the air tank and between the main body cover and the cooling fan, as viewed along the axial direction of the cooling fan, the control circuit unit is arranged to be located within the area of the air flow generated by the cooling fan. As a consequence, the control circuit unit may be arranged in a longitudinal direction in such a manner that this arrangement is directed to the vertical direction, or may be alternatively arranged in a lateral direction in such a manner that this arrangement is directed to the horizontal direction.

According to a first aspect on the invention, since the control circuit unit for driving the motor is arranged above the one pair of air tanks and at the position which is overlapped with the axial direction projection area of the cooling fan, the outside air taken by the cooling fan can be directly blown to the control circuit unit. Since the major portion of the cooing wind is firstly utilized so as to cool the control circuit unit without increasing the temperature of this cooling wind, a higher cooling effect can be achieved with employment of a small wind capacity. Also, since a large-sized cooling fan is no longer required, the cooling fan can be made compact.

According to a second aspect on the invention, since the control circuit unit contains the storage case for storing thereinto the circuit board, and is arranged in such a manner that either a portion or an overall portion of the storage case is involved in the axial direction projection area of the cooling fan, the control circuit unit is firmly arranged within the air duct of the air flow generated by the cooling fan. As a result, a higher cooling effect can be achieved.

According to a third aspect on the invention, since the storage case is arranged along a longitudinal direction in order that the storage case is located opposite to the cooling fan, only a small space may be sufficiently required without requiring such a large space capable of arranging the storage case in front of the cooling fan. As a result, the air compressor can be made compact.

According to a fourth aspect on the invention, since the storage case is formed in a rectangular parallelepiped, at least one plane of which is opened; and the opened plane is arranged to be directed to the cooling fan, the cooling wind flows from an outer circumferential wall plane of the storage case to an internal wall plane thereof, and passes through a peripheral space of a heat generating circuit element, and then, is guided to the air intake port. As a result, while heat is not close in the storage case, the effective cooling area of the cooling wind can be increased and the cooling performance thereof can be considerably improved.

According to a fifth aspect on the invention, since a semi-spherical and cylindrical-shaped fan guide is provided which is located outside the cooling fan; and the cooling wind sucked into an interior portion of the fan guide is exhausted from a side portion of the motor by the fan guide, the heat present within the motor can be effectively released.

According to a sixth aspect on the invention, since a diameter of an air sucking port of the fan guide is smaller than a width of the opened plane of the storage case, the air flow generated from the cooling fan flows from the front plane of the storage case of the control circuit unit along the side plane thereof, and can effectively cool the storage case which may function as a heat radiating fin of the heat generating circuit element. Moreover, the major portion of this air flow is sucked by the fan guide 13, so that the cooling efficiency becomes extremely high.

According to a seventh aspect on the invention, since a centrifugal fan is employed as the cooling fan, the air sucked from the air sucking port of the fan guide can be conducted along a circumferential direction and thus, the cooling wind can be conducted to such a space located in the vicinity of the stator coil positioned at the circumferential portion of the motor, so that the cooling efficiency for the stator coil can be improved. Also, since the centrifugal fan is employed, the cooling fan can be made compact, so that the air compressor can be made compact.

According to an eighth aspect on the invention, since an air ejecting port is provided in order to exhaust a portion of the sucked cooling wind to the external space without conducting the sucked cooling wind to the stator coil portion of the motor, the cooling wind ejected from the air ejecting port can be blown to the compressing unit so as to cool the compressing unit at the same time. As a result, all of the control circuit unit, the motor, the compressing unit, and the like can be cooled by utilizing one cooling fan, so that the air compressor can be furthermore made compact.

According to a ninth aspect on the invention, since an air flow generated by the cooling fan is sucked from the wind window of the front plane of the main body cover, the sucked air flow passes through the interior portion of the motor, and then, the air flow is exhausted from the wind window of the main body cover, the air flows present inside the main body cover can be made smooth by giving an influence, or by giving no influence to the air flow generated by the cooling fan mounted on the side of the compressing machine, so that increasing of the temperature can be suppressed.

According to a tenth aspect on the invention, since the control circuit unit for driving the motor is provided above the air tank and between the main body cover and the cooling fan, as viewed along the axial direction of the cooling fan, the outside air taken by the cooling fan can be directly blown to the control circuit unit. As a result, the higher cooling effect can be achieved with employment of a small wind capacity.

According to an eleventh aspect on the invention, since the control circuit unit is arranged along the longitudinal direction in front of the cooling fan, an increase of a length along the axial direction of the air tank of the air compressor can be suppressed. As a result, the air compressor can be made compact.

According to a twelfth aspect on the invention, since the control circuit unit is arranged along the lateral direction in front of the cooling fan, when there is an extra space, such an air compressor capable of achieving a higher cooling effect with respect to the control circuit unit can be realized without disturbing the air flow generated by the cooling fan.

The present invention also is made by solving the above-described disadvantages, and therefore, has an object to provide an air compressor having higher reliability and a superior environmental characteristic. Also, the present invention has another object to provide such an air compressor that vibrations and noises can be reduced, and contact failures between connectors and cables due to vibrations can be reduced. Also, the present invention has a further object to provide an air compressor having superior productivity and a superior economical aspect.

An air compressor, according to the present invention, is featured by including: a compressing unit for producing compressed air; a motor for driving the compressing unit; an air tank for storing thereinto the compressed air produced by the compressing unit; a pressure sensor for detecting air pressure within the air tank; driving control means for controlling a driving operation of the motor based upon an output signal of the pressure sensor and a preset drive condition; a switch interlocked with the driving control means; and a main body cover for covering the compressing unit and the motor; in which a frame is fixed on the air tank; and the switch is fixed on the frame.

For example, it is preferable that the frame is arranged in such a manner that at least one portion of the frame is contacted to the main body cover.

For example, it is preferable that the main body cover is fitted into the frame, or fixed on the frame.

For example, it is preferable that while the frame has a rigidness, the frame is raised on the air tank.

For example, it is featured that the frame is made of a metal.

Alternatively, the air compressor may be further comprised of: a cooling fan driven by the motor, for cooling both the compressing unit and the motor; the driving control means may be constituted by an inverter control apparatus, and is comprised of operation condition detecting unit for detecting an operation condition of the motor; and the air compressor may be further comprised of: a plurality of the switches for setting and instructing the operation condition of the motor to the inverter control apparatus based upon the output signal of the pressure sensor; and means for notifying the operation condition detected by the operation condition detecting unit.

Moreover, it is preferable that the driving control means is arranged on the frame.

In accordance with the present invention, the switch is fixed on the frame fixed on the air tank, so that the vibration level of the switch can be suppressed, and thus, the operable characteristic of the switch can be improved. Furthermore, measures against disconnections of the cables connected to the switch can be simplified, and the reliability can be improved.

According to an aspect of the present invention, there is provided an air compressor including: a pair of air tanks for storing compressed air extending along each other; a compressing unit that compresses air sucked from an external space so as to supply the compressed air to the air tanks; a motor coupled to the compressing unit so as to drive the compressing unit, while the motor and the compressing unit are arranged above the one pair of air tanks; a cooling fan that generates cooling wind provided on one end of a rotation shaft of the motor; and a control circuit unit that drives the motor arranged above the one pair of air tanks and at a position which is overlapped with an axial direction projection area of the cooling fan.

According to another aspect of the present invention, there is provided an air compressor including: a compressing unit that produces compressed air; a motor that drives the compressing unit; an air tank that stores thereinto the compressed air produced by the compressing unit; a pressure sensor that detects air pressure within the air tank; a driving control unit that controls a driving operation of the motor based upon an output signal of the pressure sensor and a preset drive condition; a switch interlocked with the driving control unit; and a main body cover that covers the compressing unit and the motor, wherein a frame is fixed on the air tank; and the switch is fixed on the frame.

DETAILED DESCRIPTION

Figure 1:
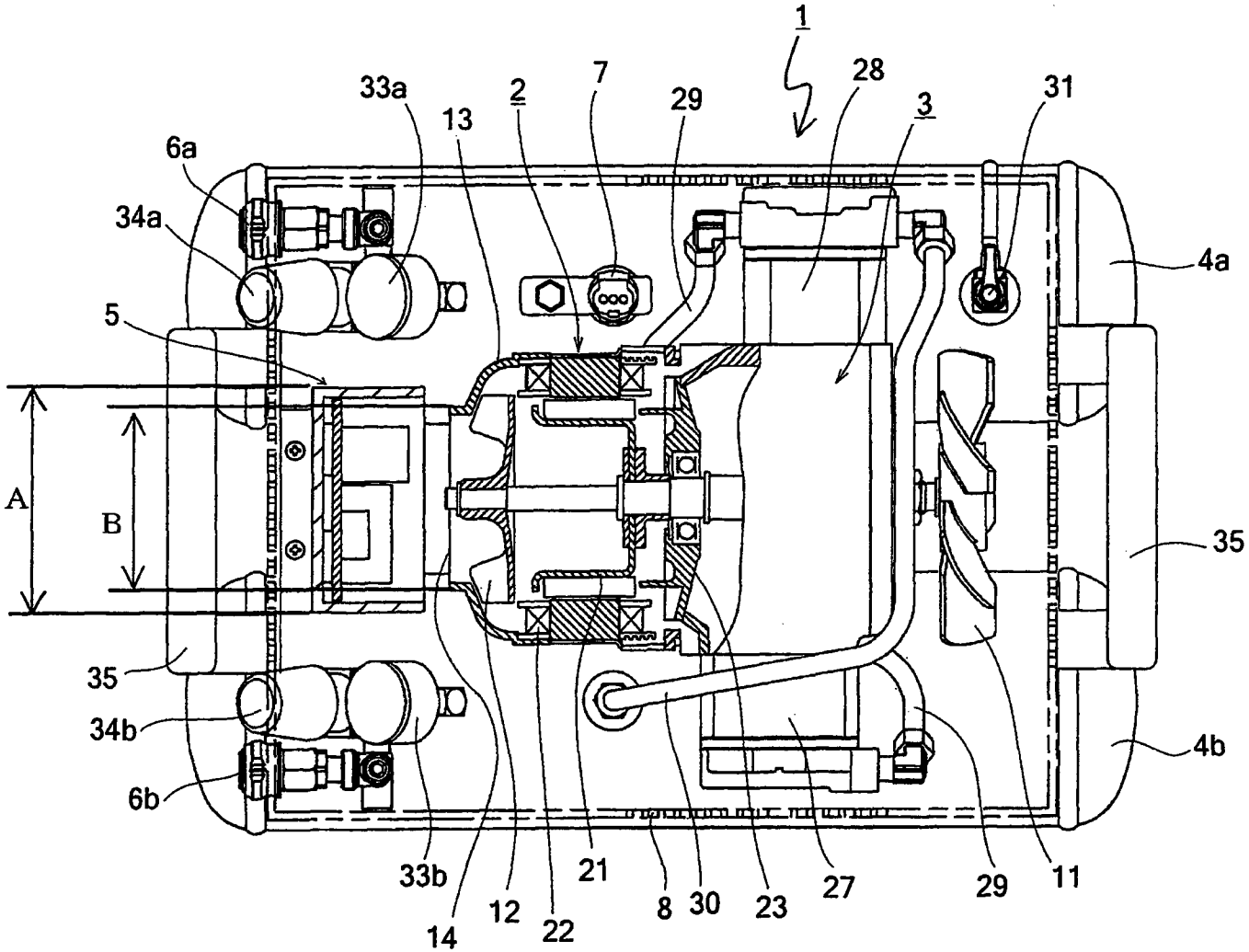
FIG. 1 is an upper view for showing an entire structure of an air compressor, which indicates a first embodiment mode of the present invention, and is a partially sectional view.

Referring now to drawings, a description is made of embodiment modes of the present invention. It should be understood that the same reference numerals will be employed as those for denoting structural elements having the same functions in the below-mentioned drawings, and therefore, repetitive explanations thereof will not omitted.

Figure 2:
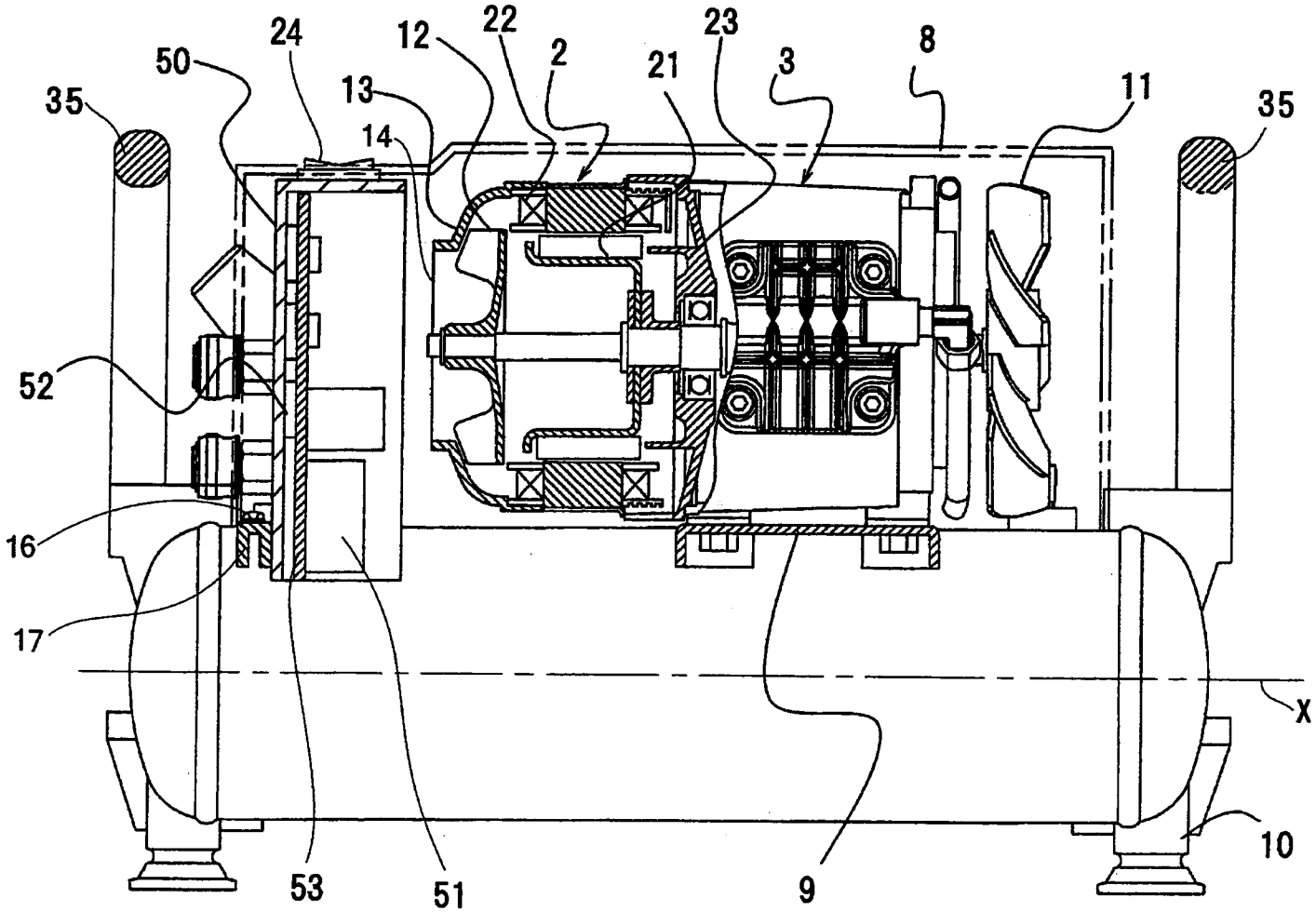
FIG. 2 is a side view for representing the air compressor shown in FIG. 1, and represents a partially sectional view.
Figure 3:
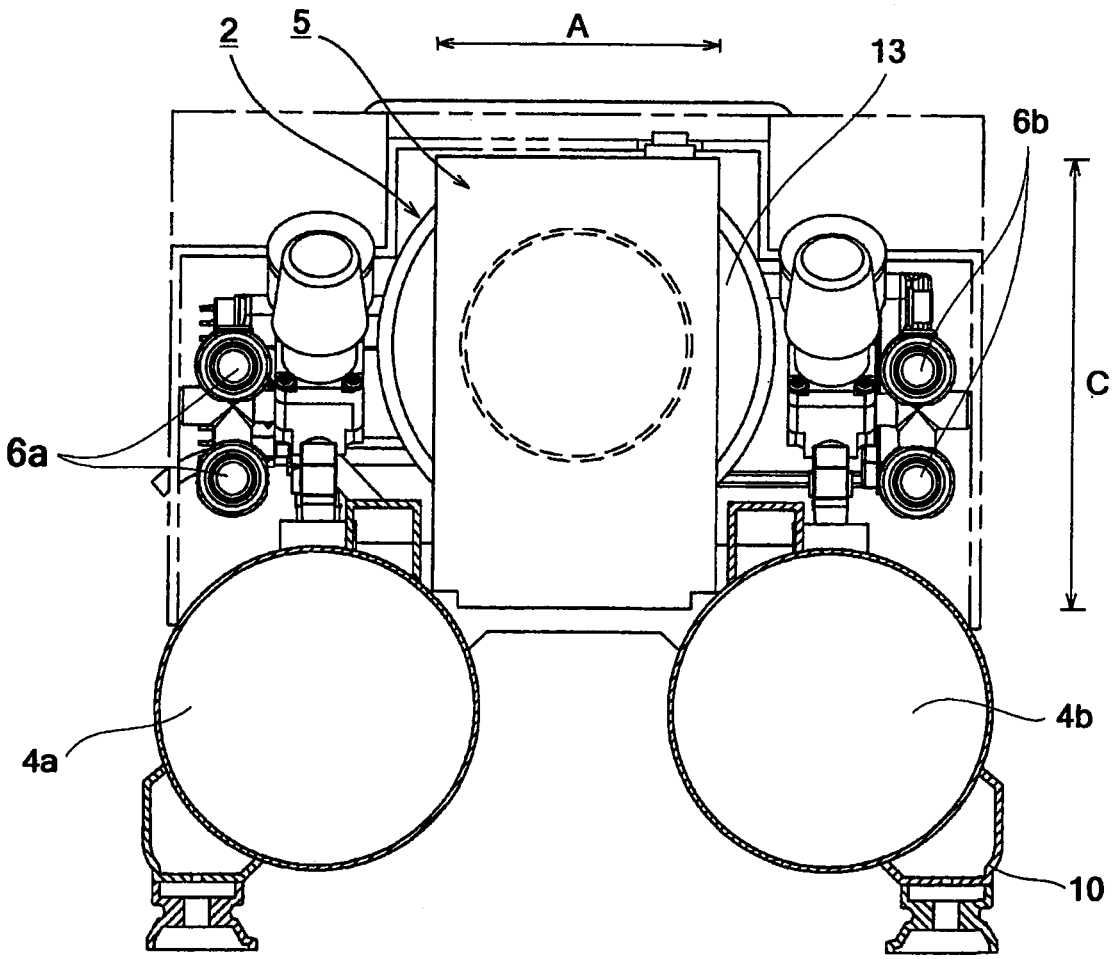
FIG. 3 is a front view for indicating the air compressor shown in FIG. 1.

FIG. 1 is an upper view for showing an entire structure of an air compressor according to a first embodiment mode of the present invention, and is a partially sectional view thereof. FIG. 2 is a side view for indicating the air compressor shown in FIG. 1, and is a partially sectional view thereof. FIG. 3 is a front view for explaining air flows of the air compressor represented in FIG. 1.

As represented in FIG. 1 to FIG. 3, an air compressor 1 according to the first embodiment mode of the present invention contains: one pair of air tanks 4*a* and 4*b* for storing thereinto compressed air; a compressing unit 3 for producing compressed air so as to supply the produced compressed air to the air tank 4*b*; a motor unit 2 for driving a motor; and a control circuit unit 5 for controlling initiating and stopping operations (ON/OFF operations) of the motor. In the drawings, portions indicated by a two-dot and chain line are sectional planes of a main body cover 8. The main body cover 8 covers at least upper portions of the air tanks 4*a* and 4*b*, the motor unit 2, the compressing unit 3, and the control circuit unit 5. A main power supply switch 24 (see FIG. 2) is provided on an upper plane of this main body cover 8, while the main power supply 24 turns ON, or OFF electric power of a commercial power supply, which is supplied to the air compressor 1.

While two sets of the above-described air tanks 4*a* and 4*b* are employed in order to store thereinto compressed air, these air tanks 4*a* and 4*b* are arranged in such a manner that the air tanks 4*a* and 4*b* are separated from each other by a constant interval in order that center axes "X" (see FIG. 2) of the respective air tanks 4*a* and 4*b* along longitudinal directions thereof become substantially parallel to each other, and further, these air tanks 4*a* and 4*b* are coupled to each other by fixing a frame 9 and another frame 17 between the air tanks 4*a* and 4*b* in either a welding manner or other arbitrary methods. Leg portions 10 (see FIG. 2 and FIG. 3) are provided under the air tanks 4*a* and 4*b*, namely, at positions lower than the center axes "X" along the longitudinal direction in order that the air compressor 1 may be easily put on a floor. Also, handles 35 are provided at a front portion and a rear portion of the air tanks 4*a* and 4*b* in order that the air compressor 1 may be easily moved.

The compressed air is generated by the compressing unit 3, and then, the compressed air is supplied from an air ejecting port of the compressing unit 3 via an air ejecting pipe 30 to the air tank 4*b*. The supplied compressed air has a pressure value of, for example, 3.0 to 4.2 MPa within the air tank 4*b*. Also, while the air tanks 4*a* and 4*b* are coupled to each other by a coupling pipe (not shown), pressure values of both the tanks 4*a* and 4*b* are kept equal to each other. A safety valve (pressure relief valve) 7 is mounted in the air tank 4*a*, and this safety valve 7 ejects a portion of the compressed air stored in the air tanks 4*a* and 4*b* to an external space (namely, outside air compressor 1) when the pressure value of the compressed air within the air tanks 4*a* and 4*b* becomes excessively high so as to prevent an abnormal increase of the pressure value.

Two sets of couplers 6*a* and 6*b* which constitute compressed air deriving ports are provided on both the air tanks 4*a* and 4*b*, and a pneumatic tool (not shown) such as a nailing machine is connected via a hose (not shown) to these couplers 6*a* and 6*b*. As can be understood from FIG. 2, in the first embodiment mode, although two sets of these couplers 6*a* and 6*b* are provided at upper and lower positions of the air tanks 4*a* and 4*b* respectively, a total number and setting places of couplers may be arbitrarily set.

While pressure reducing valves 34*a* and 34*b* are provided adjacent to the couplers 6*a* and 6*b* respectively, these pressure reducing valves 34*a* and 34*b* have a function capable of suppressing the maximum pressure value of the compressed air on the side of exits (on the side of couplers) to a constant pressure magnitude, irrespective of magnitudes of pressure of the compressed air on the side of inlets thereof. For example, in such a case that pressure reducing valves having maximum pressure value of 2.0 MPa are employed as these pressure reducing valves 34*a* and 34*b*, even when pressure values of the compressed air contained in the air tanks 4*a* and 4*b* are higher than, or equal to 2.0 MPa, only such compressed air having pressure values lower than, or equal to 2.0 MPa is outputted from the pressure reducing valves 34*a* and 34*b*, so that such compressed air having a pressure value lower than, or equal to the desirable maximum pressure value of 2.0 MPa. Pressure meters 33*a* and 33*b* are mounted in the vicinity of the couplers 6*a* and 6*b*, so that these pressure meters 33*a* and 33*b* can monitor pressure values on the side of the exits of the pressure reducing valves 34*a* and 34*b*. While a drain exhausting unit 31 is provided in the vicinity of a rear end portion of the air tank 4*a*, both the compressed air contained in the air tanks 4*a* and 4*b*, and vapor contained in the compressed air can exhaust drains (water components) stored in the bottom portions of the air tanks 4*a* and 4*b* via the drain exhausting unit 31.

As indicated in FIG. 1, while the compressing unit 3 is constituted by two sets of compressing machines 27 and 28, the first-staged compressing machine 27 and the second-staged compressing machine 28 are arranged in such a manner that the first-staged compressing machine 27 is located opposite to the second-staged compressing machine 28 via a crank case. The first-staged compressing machine 27 compresses external air (atmospheric pressure) sucked via the interior portion of the crank case, and then, feeds the compressed air via a first air ejecting pipe 29 to the second-staged compressing machine 28. The second-staged compressing machine 28 compresses the compressed air supplied from the first-staged compressing machine 28 up to an allowable maximum pressure value of, for example, 3.0 to 4.2 MPa, and then, supplies the secondly compressed air to the air tank 4*b* via a second air ejecting pipe 30.

An electric motor which constitutes the motor unit 2 corresponds to such a DC brushless type motor that, for instance, a rotation position of a rotor 21 is detected by a detecting means (not shown) such as a Hall element, and then, a supply of electric power to a stator coil 22 is controlled in response to the detection signal. The supply of the electric power is controlled by the control circuit unit 5 in an inverter control mode.

The motor unit 2 has a rotator and a stator. The rotator is constructed of the rotor 21 in which a rotation shaft thereof is arranged in such a manner that this rotation shaft is located substantially parallel to the center axial lines "X" of the air tanks 4*a* and 4*b* along the longitudinal direction thereof, while a permanent magnet is mounted on an outer circumferential portion of a cup-shaped rotor housing. In the stator, the stator coil 22 corresponding to a field winding is arranged on the side of the outer circumferential portion of the stator. The stator has such a structure that while the stator coil 22 is wound on a plurality of iron cores, since gaps are formed among the respective iron cores (magnetic poles), wind can be blown via the gaps along the shaft direction of the electric motor. The compressing unit 3 is coupled via a stator holder 23 to one end side of the motor housing of the motor unit 2, and the compressing unit 3 is fixed on the frame 9 which is coupled between the air tanks 4*a* and 4*b* by employing a bolt.

One end of the rotation shaft of the motor passes through the crank case of the compressing unit 3 and then is elongated, while a cooling fan 11 is mounted on this elongated end. Although the first embodiment mode has exemplified such an example that an axial flow fan is employed as the cooling fan 11, the present invention is not limited only to this exemplification. Any types of fans may be alternatively employed if these alternative types of fans may produce large amounts of air flows capable of realizing the desirable cooling function. Since the cooling fan 11 is operated, air (outside air) is absorbed from wind windows 81*a* and 81*b* formed in the side plane of the main body cover 8, the absorbed air cools the compressing unit 3, and thereafter, the resulting air is exhausted from another wind window 82 formed in the rear plane of the main body cover 8.

Another cooling fan 12 formed by a resin molding method, in which a vane shape is provided, is mounted on the other end portion of the rotation shaft of the motor in order that outside air is absorbed from another wind window 83 formed in the front plane of the main body cover 8 and the absorbed air is conducted to the motor unit 2. While the cooling fan 12 is a centrifugal fan, a semi-spherical and cylindrical-shaped fan guide 13 is provided on the outer side of this centrifugal fan. The above-described fan guide 13 is made of a resin material and is employed in order to guide an air flow to the stator coil 22, while the air flow is produced along a centrifugal direction by rotating the cooling fan 12. Even when a centrifugal fan has the same dimension as that of an axial flow fan, the centrifugal fan can produce a relatively larger wind capacity, as compared with a wind capacity of the axial flow fan. As a result, the centrifugal fan is suitable for making an apparatus compact. In the fan guide 13, two opening portions formed in both ends of this fan guide 13 along an axial direction have circular shapes, and a larger opening portion is mounted on the stator housing of the motor 2. As a mounting method, any arbitrary mounting method selected from an adhering method, a fitting method, a screwing method, and the like may be employed. An air sucking port 14 corresponding to a smaller opening portion of the fan guide 13 has such a diameter dimension "B" which is slightly smaller than a width dimension "A" of a storage case 50 of the control circuit unit 5, as indicated in FIG. 1, and the air sucking port 14 is set in such a manner that this air sucking port 14 is positioned at a front plane of the storage case 50. In FIG. 3, double circles which are drawn by dotted lines inside the control circuit unit 5 indicate a position of an outer diameter of the cooling fan 12, and a position of the air sucking port 14. Such an area that a range of the circle for indicating the position of the outer diameter of the cooling fan 12 is projected (elongated) along the axial direction corresponds to a projection area where the cooling fan is projected along the axial direction. In FIG. 3, it is possible to understand that a portion of the control circuit unit 5 is contained in this projection area of the axial direction.

As shown in FIG. 2, the control circuit unit 5 is arranged by a power supply-purpose circuit component 51, a semiconductor switching element 52 for controlling driving operations of the motor in the inverter control mode, and a circuit board 53 which has mounted thereon other circuit element components. Heat generating components such as the semiconductor switching element 52 are arranged within the storage case 50, the four planes of which is formed by a material having a better thermal conducting characteristic such as aluminum. An arranging position of the storage case 50 is located above one pair of the above-described air tanks 4*a* and 4*b*, namely, is located on the upper side higher than the longitudinal axes of the air tanks 4*a* and 4*b*, and further, is set in such a manner that a longitudinal plane of a rectangular parallelepiped (namely, such a plane having largest area within rectangular parallelepiped) becomes either a longitudinal direction or a vertical direction between the cooling fan 12 and the main body cover 8. A fixing-purpose bearing surface 16 provided on a front plane of the storage case 50 is made coincident with the frame 17 of the air tanks 4*a* and 4*b* and is fixed on this frame 17 by using a bolt. Although the storage case 50 may be made of such a rectangular parallelepiped that all of planes thereof are closed, the storage case 50 is constructed of such a rectangular parallelepiped that two planes thereof are opened in the first embodiment mode, while the storage case 50 is fixed under such a condition that one plane of the two opened planes thereof is directed to the side of the cooling fan 12 and the other plane is directed to the side of the air tanks 4*a* and 4*b*, namely, is directed to the lower side. Since the lower-sided plane of the storage case 50 is opened, the below-mentioned merit may be achieved. That is, it is possible to avoid that dust is accumulated within the storage case 50, and even if dew is formed in the storage case 50, water components may be easily exhausted, since the lower-sided plane thereof is opened. The heat generating components are stored in the storage case 50 in such a manner that the heat generating components are contacted close to the storage case 50 in order that the storage case 50 may function as a heat radiating fin of the heat generating components.

Figure 4:
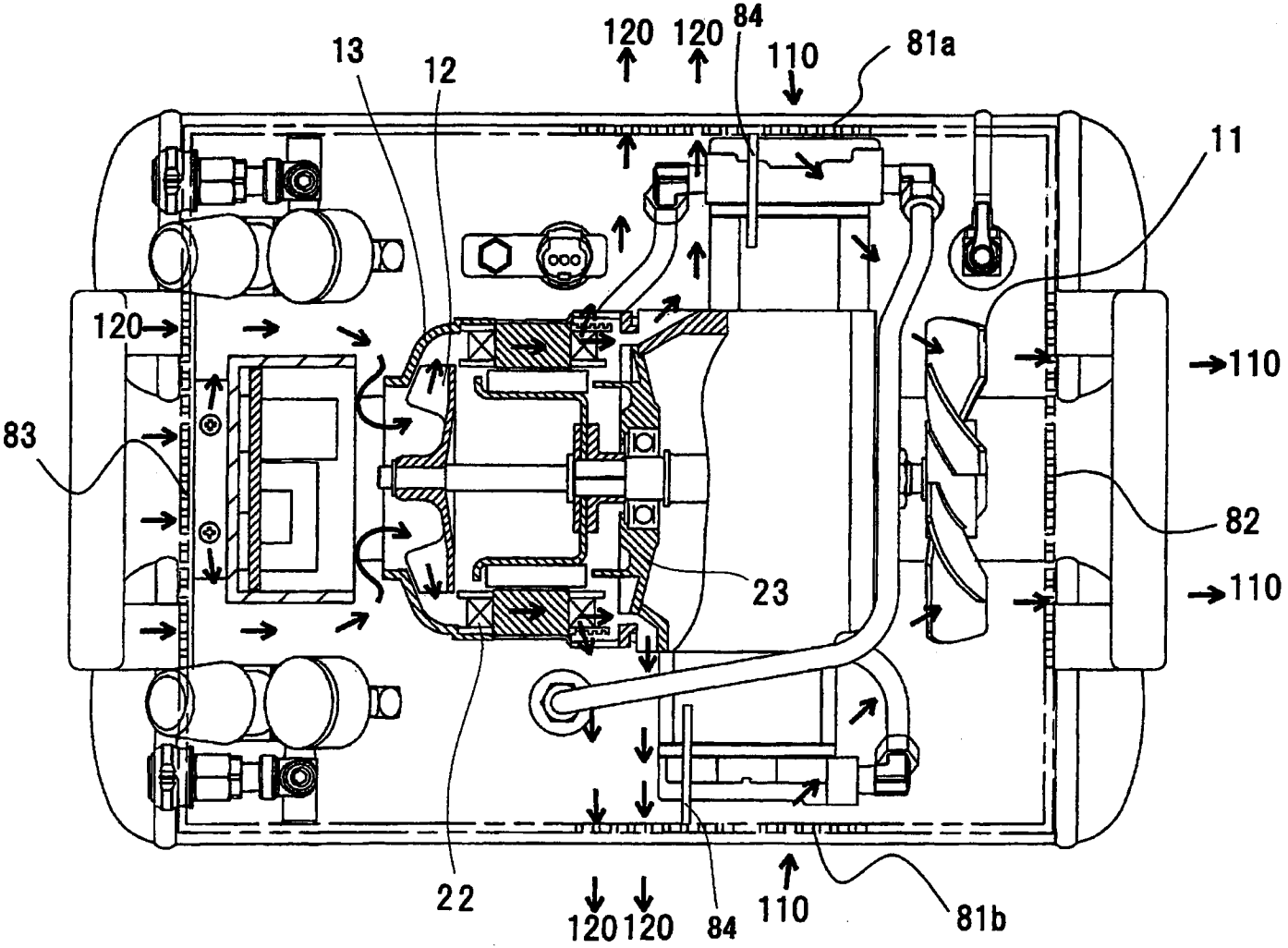
FIG. 4 is a partially sectional and upper view for explaining air flows within the air compressor shown in FIG. 1.
Figure 6:
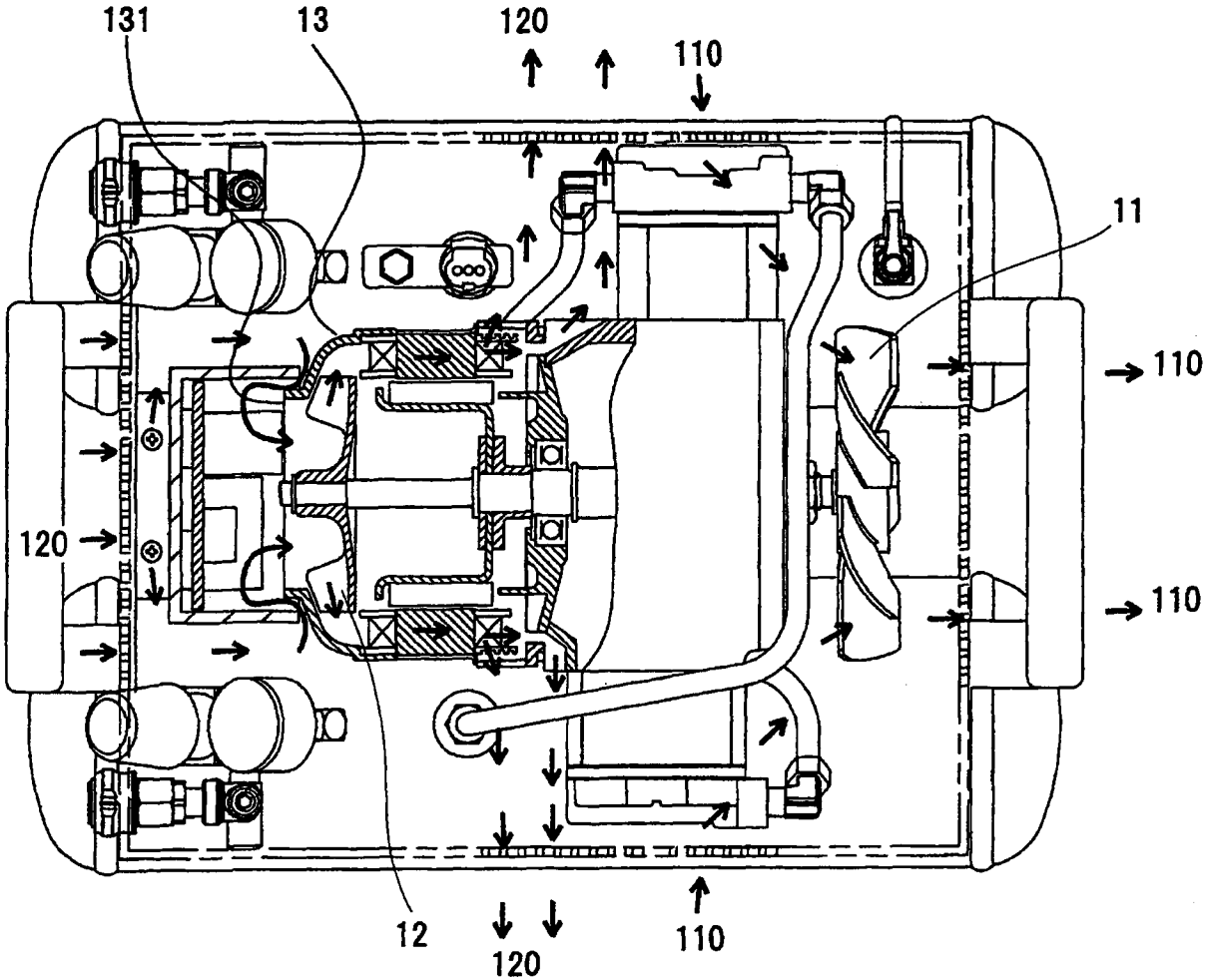
FIG. 6 is an upper view for showing an entire structure of an air compressor, which indicates a second embodiment mode of the present invention, and is a partially sectional view.

Since the air compressor 1 is equipped with the above-described arrangement, the cooling fans 11 and 12 mounted on the shaft end portions of the motor are rotated respectively by rotating the motor, so that air flows 110, 120*a*, 120*b* are generated, which are indicated by arrows in FIG. 4 and FIG. 6. As can be understood from FIG. 4, the air flow 110 generated by the cooling fan 11 is exhausted from the wind window 82 formed in the rear plane of the main body cover 8 to the external space (namely, outside air compressor 1) in such a manner that the outside air is sucked form the air sucking-purpose wind windows 81*a* and 81*b* formed in the side plane of the main body cover 8, the sucked air flow cools the compressing machines 27 and 28, and thereafter, the sucked air flow is absorbed by the cooling fan 11. Also, since the space defined between one pair of the air tanks 4*a* and 4*b* is opened by providing a constant gap, as indicated by the air flows 120*a* and 102*b*, a portion of the above-described air flow 110 can smoothly pass through the space between the air tanks 4*a* and 4*b*, and then can be smoothly exhausted by being also exhausted from the stator holder 23 along the lower circumferential direction. More specifically, since the control circuit unit 5 is not located under the frame 17 which couples the air tanks 4*a* and 4*b*, air flows along the lower direction can be made smooth, so that the cooling efficiency can be improved.

On the other hand, the air flow 120 generated by the cooling fan 12 is sucked from the air sucking-purpose wind window 83 formed in the front plane of the main body cover 8, and then, the sucked air flow 120 flows along the side plane of the storage case 50 from the front plane of this storage case 50 for storing the control circuit unit 5. As a result, the air flow 120 can effectively cool the storage case 50 functioning as the heat radiation fin of the heat generating circuit elements, and thereafter, is absorbed into the fan guide 13. Since the diameter dimension "B" of the fan guide 13 is substantially equal to, or smaller than the width dimension "A" of the storage case 50, the cooling wind flown along the side plane of the storage case 50 can smoothly flow without being exfoliated from the storage case 50, and then, is guided into the fan guide 13.

Figure 5:
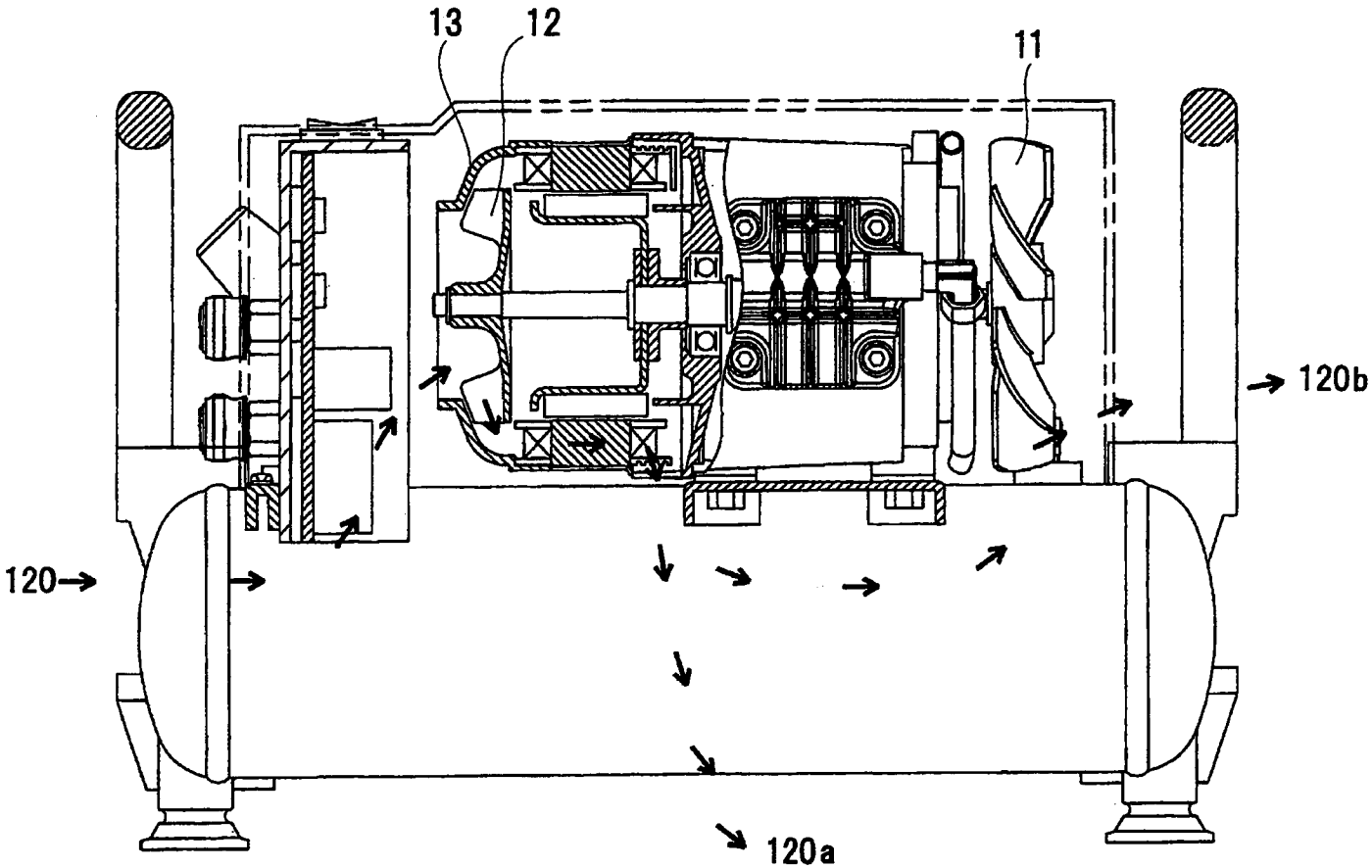
FIG. 5 is a partially sectional and upper view for explaining air flows within the air compressor shown in FIG. 1.

The cooling wind 120 sucked into the fan guide 13 passes through the interior portion of the semi-spherical and cylindrical-shaped fan guide 13, and passes through the stator coils 22 of the motor, and then, is divided along the right direction and the left direction by the guide rib provided in the radial form on the circumference of the stator holder 23, and along the lower direction on the air tank side by this rib, and thereafter, the cooling wind 120 is exhausted from the interior portion of the motor. The shape of this guide rib may be formed as follows: That is, this rib may conduct the air flows along the target directions without giving an adverse influence to the air flow 110 generated by the cooling fan 11 provided on the side of the compressing unit 3 in such a manner that the exhaust air flows along the right and left directions may be exhausted from the exhausting-purpose wind windows 81*a* and 81*b* formed in the side plane of the main body cover 8, and the exhaust air flow along the lower direction may pass under the air tanks 4*a* and 4*b*, or between the air tanks 4*a* and 4*b*, as indicated by either 120*a* or 120*b* of FIG. 5, and then, may be exhausted. Alternatively, a total number and shapes as to guide ribs and flow ducts for exhaust air may be arbitrarily set in response to a required air glow rate.

It should also be noted that since the exhausted air flow by the cooling fan 11 and the sucked air flow by the cooling fan 12 are mixed with each other at the wind windows 81*a* and 81*b* formed in the side plane of the main body cover 8, a rib 84 (see FIG. 4) for cutting off the air flows is provided at a boundary between these wind windows 81*a* and 81*b*, so that efficiencies of air sucking/exhausting operations can be improved. For instance, the above-described rib 84 may be molded with the main body cover 8 in an integral body inside the main body cover 8, and further, may be realized by providing a plate made of a metal, or a plastic material on the side of the compressing unit 3. It is preferable that dimensions (widths and heights) of the respective wind windows 81*a*, 81*b*, 82, and 83 are made as large as possible in connection with the dimension of the main body cover 8. However, these dimensions of the wind windows 81*a*, 81*b*, 82, and 83 may be arbitrarily set by considering air flows, and the like.

Next, a description is made of another embodiment mode according to the present invention with reference to FIG. 6. FIG. 6 is an upper view for showing an entire structure of an air compressor according to a second embodiment mode of the present invention, and indicates a partially sectional view thereof. In FIG. 6, in order that the opening plane of the storage case 50 for the control circuit unit 5 is approximated to the motor unit 2, an air sucking port 131 of the fan guide 13 is arranged in such a manner that the air sucking port 131 is positioned on an inner side rather than the opening plane of the storage case 50. Since the air sucking port 131 is arranged in the above-described manner, substantially all portions of the air sucked from the cooling fan 12 pass through the inner portion of the control circuit unit 5 and thereafter are sucked, so that the cooling effect with respect to the control circuit unit 5 can be extremely increased. Also, since the storage case 50 is arranged to be approximated to the motor unit 2 as close as possible, such a space required for setting thereinto, the control circuit unit 5 can be minimized, so that the air compressor can be made compact.

Figure 7:
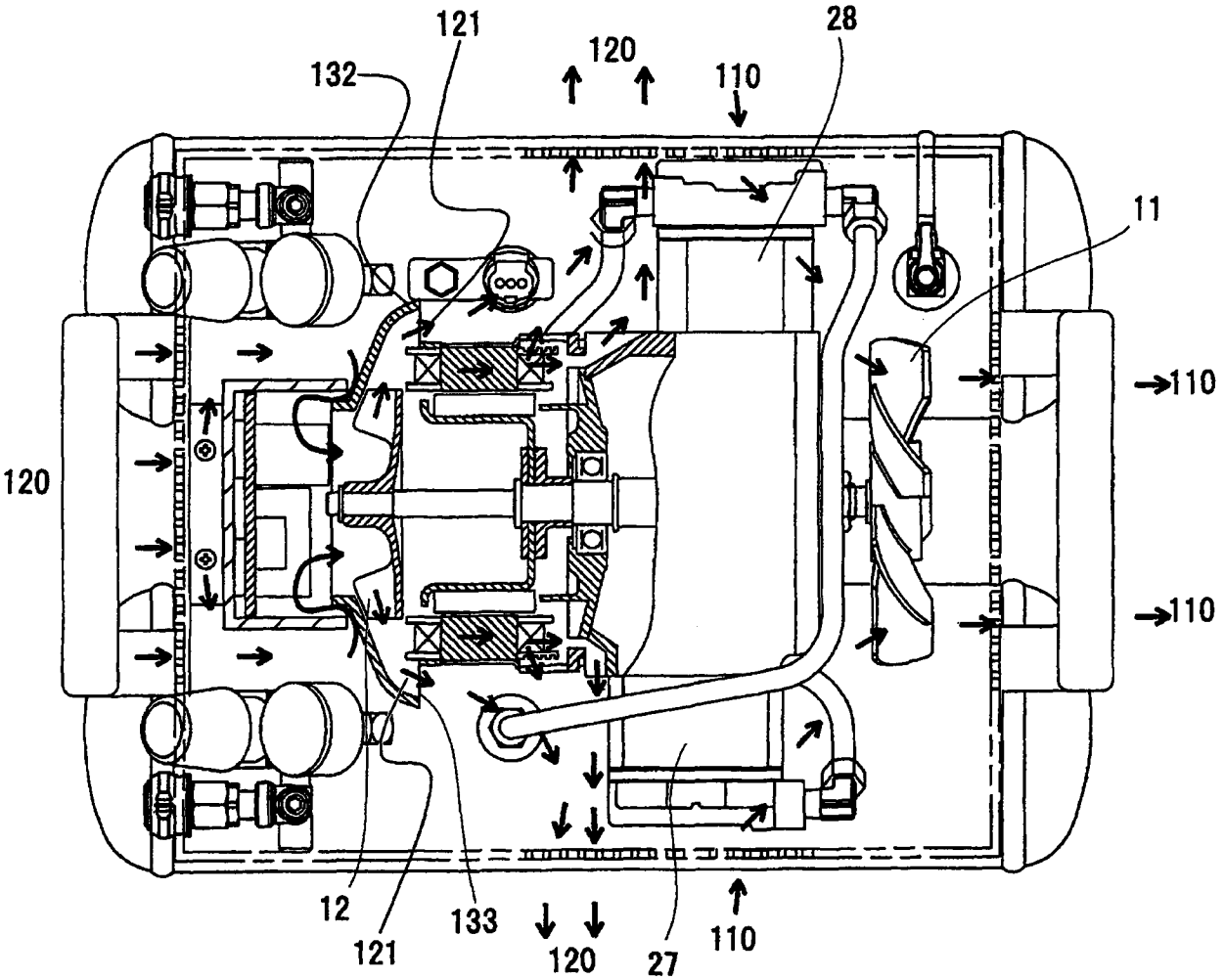
FIG. 7 is an upper view for showing an entire structure of an air compressor, which indicates a third embodiment mode of the present invention, and is a partially sectional view.

Next, a description is made of a further embodiment mode according to the present invention with reference to FIG. 7. FIG. 7 is an upper view for showing an entire structure of an air compressor according to a third embodiment mode of the present invention, and indicates a partially sectional view thereof. In FIG. 7, at a portion of a circumference of a fan guide 132 having a semi-spherical shape, for example, at two right and left portions, air ejecting ports 133 are formed, so that a portion of air may be conducted into the interior portion of the motor, and the remaining air may be ejected via the air ejecting ports 133 to the external space. In the example of FIG. 7, the air ejecting ports 133 are provided only in the right and left portions of the motor; and in the upper and lower portions, no opening portion is provided around the fan guide 132. A portion of air flows sucked by the cooling fan 12 via the air ejecting ports 133 can be exhausted outside the fan guide 132 without passing through the spaces between the stator coils 22, and the exhausted wind can be conducted to be blown to the compressing machines 27 and 28 in a higher efficiency. Shapes and angles of the air ejecting ports 133 are adjusted in response to positions of structural portions which should be cooled. If the air compressor 1 is arranged in the above-described manner, then a cooling degree of the motor unit 2 and a cooling degree of the compressing unit 3 can be distributed based upon the dimensions, the shapes, and the directions of the air ejecting ports 133 of the fan guide 132. As a result, the cooling effect with respect to the air compressor 1 can be improved with employment of the above-explained simple structure.

It should also be noted that the air ejecting ports 133 may be employed so as not only to cool the compressing machines 27 and 28, but also to adjust the air flows within the main body cover 8. Accordingly, air exhausting angles and a total number of air exhausting ports may be arbitrarily set.

As previously described, in accordance with the air compressor of the present invention, the outside air taken by the cooling fan can be directly blown to the control circuit unit 5, and thus, the major wind portions of the cooling wind can be utilized so as to cool the control circuit unit 5, while the temperature of the cooling wind is not increased. As a result, the higher cooling effect can be achieved by utilizing a small amount of the cooling wind. Moreover, in accordance with the present invention, since the setting place of the control circuit unit 5 for controlling the rotations of the motor is properly contrived, such electronic elements as the inverter control means which generate large amounts of heat can be cooled in the higher efficiency. In accordance with the arrangement of the present invention, the control circuit unit 5 is installed along the longitudinal direction. As a result, dust can be hardly accomplished in the storage case 50 for storing thereinto the control circuit unit 5. In addition, the control circuit unit 5 is arranged on the upper side of the air tanks in the above-described arrangement of the present invention, as compared with the arrangement of the control circuit unit in the conventional air compressor, namely, this control circuit unit is provided between one pair of the air tanks and under the frame. As a consequence, such a risk that the control circuit unit 5 may bump against a certain article in such a case where the air compressor 1 is moved by utilizing casters (not shown) provided on the leg portion 10 may be largely decreased.

The present invention is not limited only to the above-described first to third embodiment modes, but may be modified and changed in various manners without departing from the gist of the present invention.

For example, in the above-described first to third embodiment mode, the cooling fan 11 mounted on the side of the compressing unit 3 is arranged as the air ejecting type axial flow fan. Alternatively, this cooling fan 11 may be arranged as an air intake type axial flow fan, since the air flow 120 which has cooled the motor unit 2 can be exhausted to the external space without disturbing the air flow 110 of the cooling fan 11 in accordance with the present invention. In this alternative case, the air flow 110 shown in FIG. 4 may be alternatively generated along such a direction opposite to the above-explained direction.

Also, the type of the cooling fan 11 may not be limited only to an axial flow fan, but any types of cooling fans may be employed if the inner wall of the main body cover 8 is designed in such a manner that cooling air flows of the compressing unit 3 can be smoothly exhausted. For example, even when a centrifugal fan is employed as this cooling fan 11, a similar effect may be achieved. In addition, the shape of the fan guide 13 provided in correspondence with the cooling fan 11 may be realized as not only the semi-spherical shape, but also other shapes. For example, a sectional plane of such a fan guide may be made in a substantially rectangular shape.

Moreover, in the above-described first to third embodiment modes, the description is made in that the cooling fan 12 corresponds to the centrifugal fan. However, the present invention is not limited only to this centrifugal fan. Alternatively, even when arbitrary types of fans such as an axial flow fan are employed, similar effects may be achieved.

Next, a description is made of an air compressor 1 according to a fourth embodiment mode of the present invention.

Figure 8:
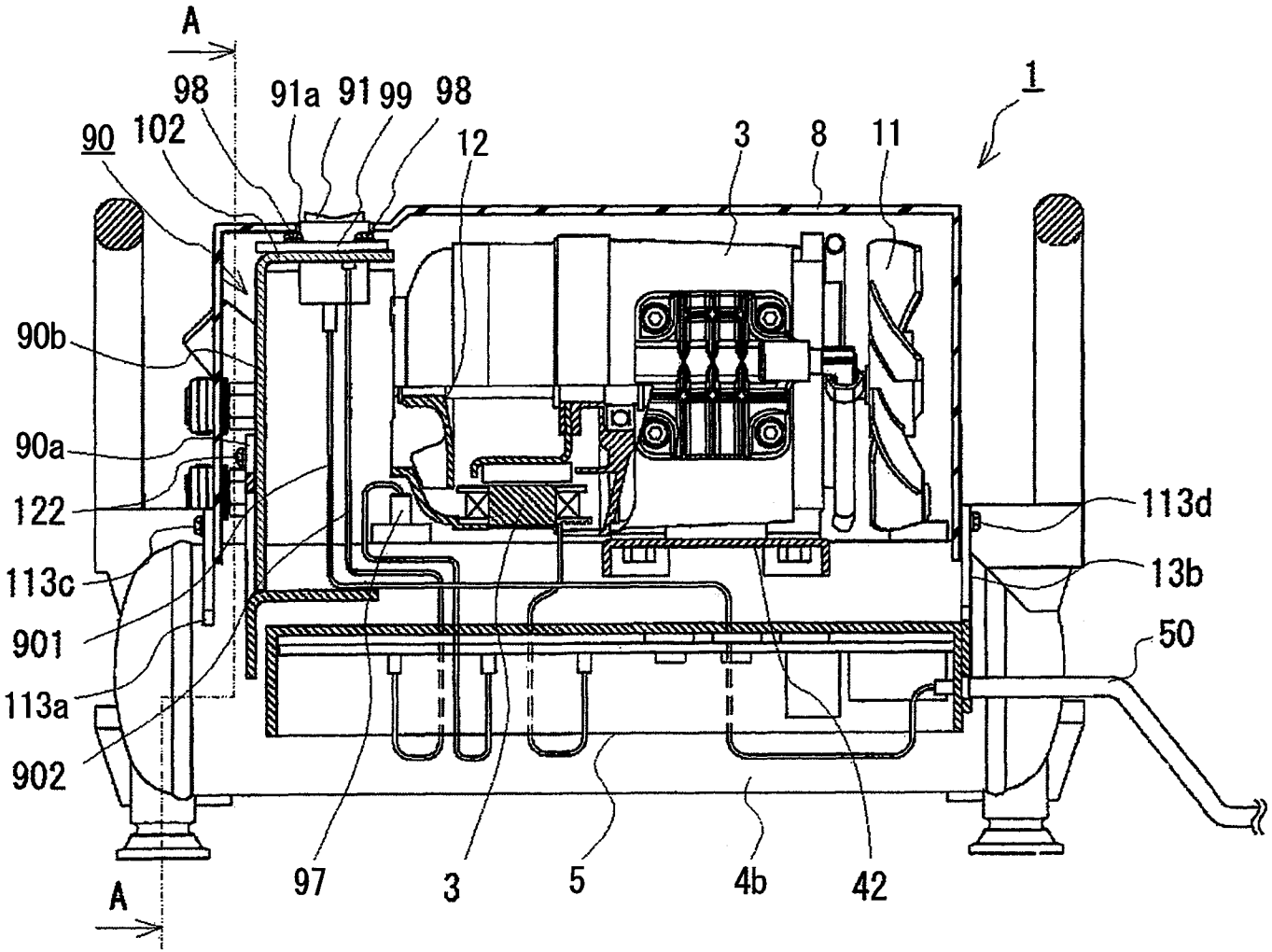
FIG. 8 is a side view (partially sectional view) for showing an air compressor according to a fourth embodiment mode of the present invention.
Figure 9:
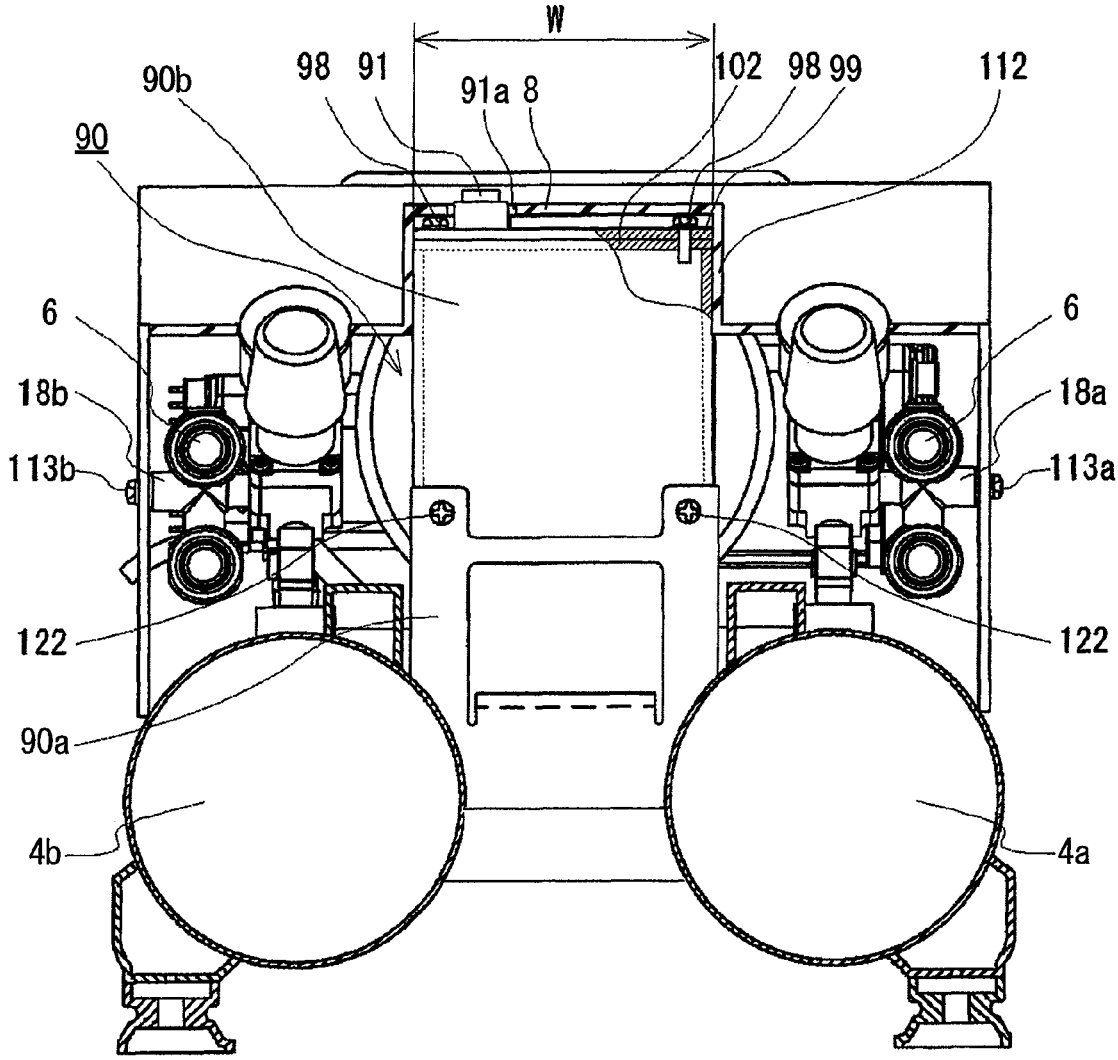
FIG. 9 is a front view (partially sectional view) for indicating the air compressor according to the fourth embodiment mode of the present invention, namely, is a diagram of the air compressor, taken along an arrow line "A-A" of FIG. 8.

Firstly, a description is made of a structure of the air compressor 1 according to fourth embodiment mode. As shown in FIG. 8 and FIG. 9 (namely, FIG. 9 is sectional view of air compressor 1, taken along arrow line A-A of FIG. 8), the air compressor 1 is constructed by employing a motor unit 2, a compressing unit 3, an air tank 4 (4*a* and 4*b*), a pressure sensor 97, couplers 6, cooling fans 11 and 12, an operation panel 99, a frame 90, a control circuit unit 5, and a main body cover 8.

The motor unit 2 corresponds to a power source of the air compressor 1, and is fixed on a horizontal frame (not shown) at a center portion of the air compressor 1 so as to be mounted on this horizontal frame. The motor unit 2 is driven by the control circuit unit 5 in an inverter mode.

The air tank 4 is equipped with one pair of air tanks 4*a* and 4*b* which are formed in long body shapes so as to store therein compressed air under pressure. When one pair of these air tanks 4*a* and 4*b* are called as a generic name, these paired tanks 4*a* and 4*b* will be referred to as the "air tank 4." One pair of the air tanks 4*a* and 4*b* are communicated with each other by a coupling pipe (not shown).

The compressing unit 3 is mounted on a horizontal frame 42 bridged over upper ends of the air tanks 4*a* and 4*b*, and is equipped with a piston/cylinder unit (not sown) in which a piston (not shown) is connected to a crank shaft (not shown) mounted on a rotation shaft of the motor unit 2.

The couplers 6 are fixed on the main body cover 8, and are connected via pressure reducing valves (not shown) to the air tank 4. When compressed air is supplied to a pneumatic tool (not shown), the couplers 6 are connected via an air hose and the like to the pneumatic tool.

The pressure sensor 97 is arranged in one of the air tanks 4*a* and 4*b* so as to sense pressure of compressed air contained in the air tank 4, and so as to supply a pressure detection signal to the control circuit unit 5.

The cooling fans 11 and 12 is arranged in such a manner that the cooling fans 11 and 12 sandwich the motor unit 2 and the compressing unit 3, and is coupled to the rotation shaft of the motor unit 2.

The control circuit unit 5 are arranged by employing a circuit board where a semiconductor switching IC (Integrated Circuit) and the like are arranged, and various sorts of sensors (power supply voltage sensor, temperature sensor etc.) which are not shown. The circuit board of the control circuit unit 5 is connected via a signal cable 902 to the motor unit 2, the pressure sensor 97, and the operation panel 99. An operation program is previously stored in a storage element, while the operation program drives the motor unit 2 in accordance with a detection value of the pressure sensor 97 and a setting value produced by operating the operation panel 99.

The operation panel 99 has a function of a user interface, and has equipped with an ON/OFF switch (button) 91, a mode (function) selecting switch 92, an UP switch 93, a DOWN switch 94, a decision switch 95, a display unit 96, a buzzer 97, and the like. The operation panel 99 is connected to the control circuit unit 5 via a cable, a connector, and the like.

A frame 90 is employed in order to arrange thereon the operation panel 99 and to support the main body cover 8. The frame 90 is arranged by being raised from the air tank 4 at a front portion of this air compressor 1. The frame 90 is constructed of a fixing portion 10*a* fixed to the air tanks 4*a* and 4*b*, and a supporting portion 10*b* fixed to the fixing unit 10*a*.

Figure 11B:
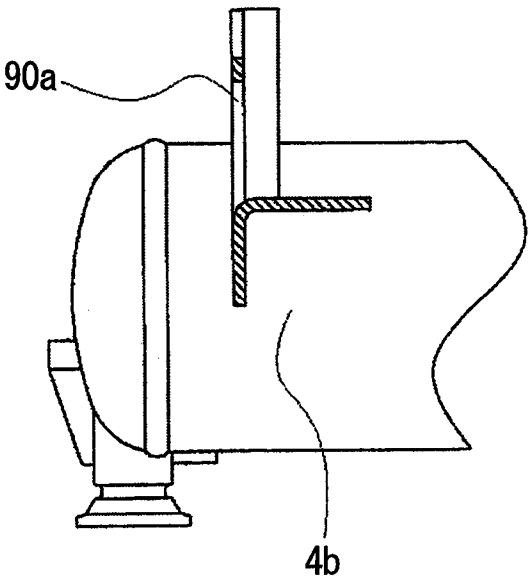
FIG. 11B is an enlarged side view taken along an arrow line "B-B" of FIG. 11A.
Figure 11A:
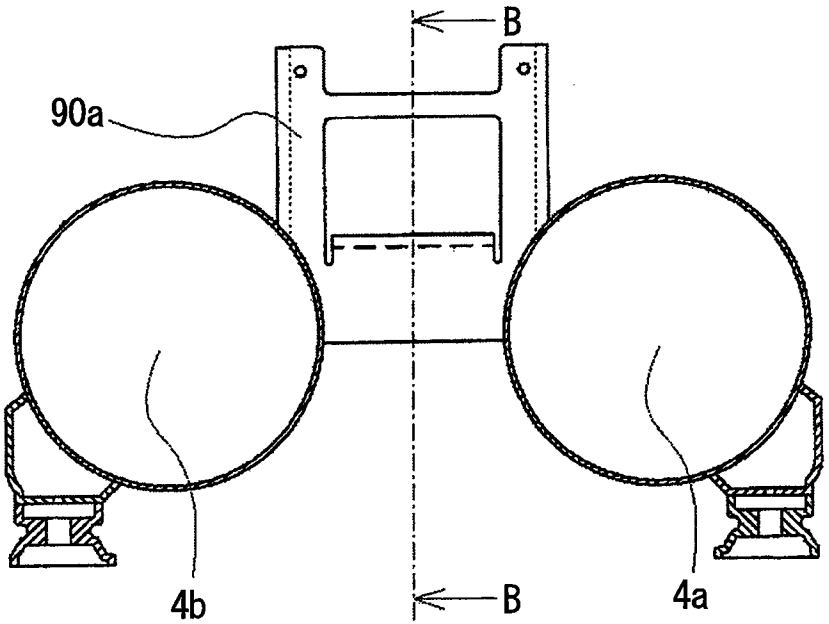
FIG. 11A is an enlarged front view (partially sectional view) for indicating a fixed unit of the air compressor shown in FIG. 8 and FIG. 9.

The fixing portion 10*a* is constituted by employing, for example, an aluminum plate, a steel plate, a stainless steel plate, or the like, the thickness of which is selected to be 3 to 10 mm, for instance, approximately 5 mm. As indicated in FIG. 11A and FIG. 11B in an enlarged mode, the fixing portion 10*a* is welded to one pair of the air tanks 4*a* and 4*b* so as to be fixed on these air tanks 4*a* and 4*b*.

Figure 10:
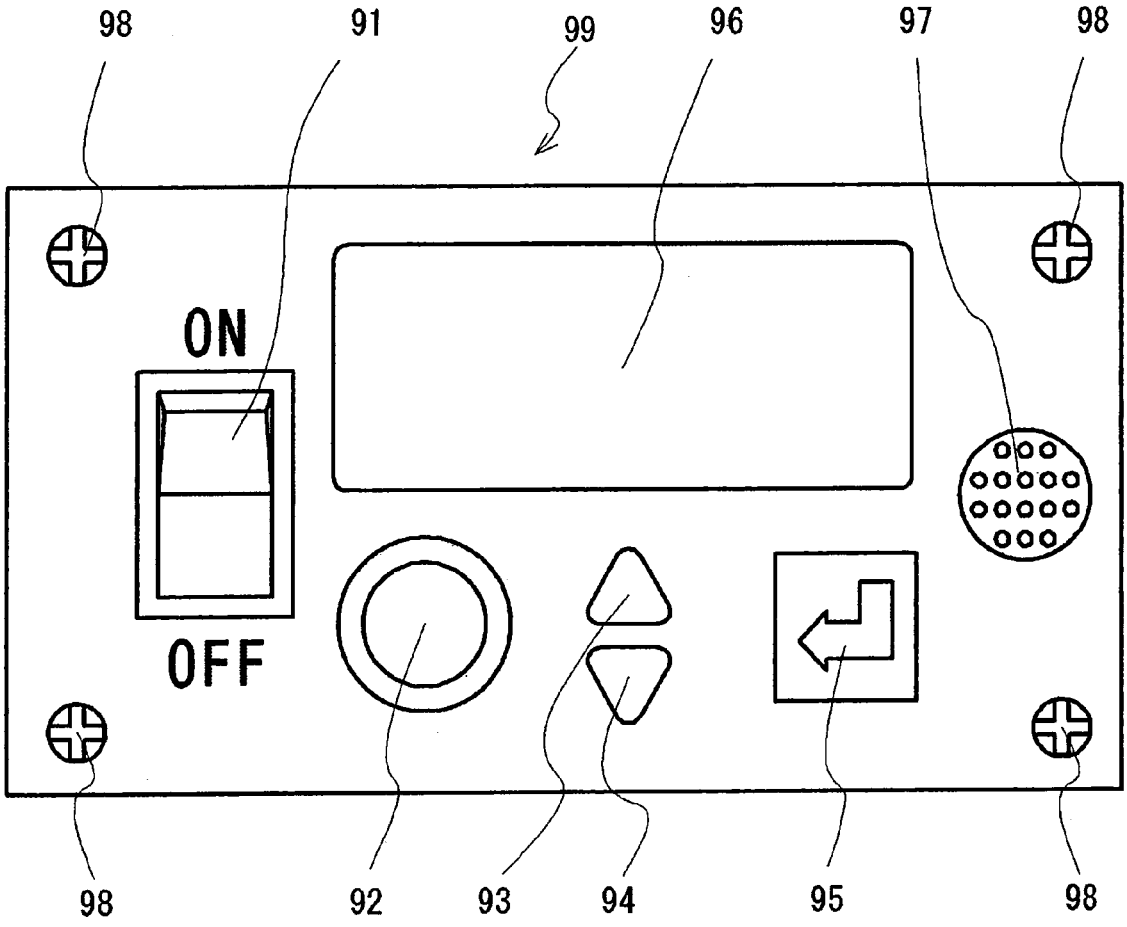
FIG. 10 is an upper view for representing an operation panel of the air compressor shown in FIG. 8.
Figure 12A:
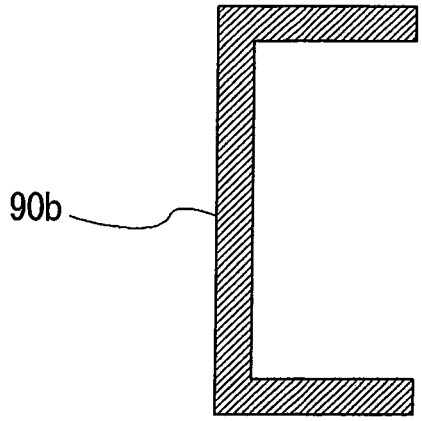
FIG. 12A to 12C are a diagram for representing a modification of a frame.
Figure 12B:
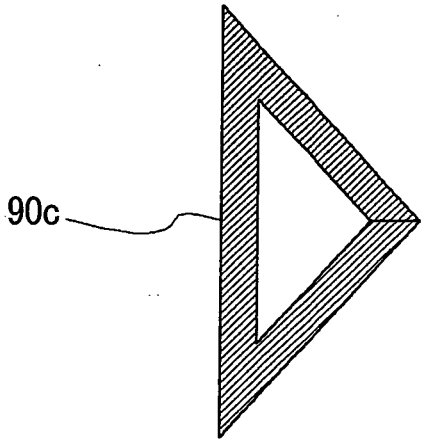

The supporting portion 10*b* is constituted by employing for example, an aluminum plate, a steel plate, a stainless steel plate, or the like, the thickness of which is selected to be 3 to 10 mm, for instance, approximately 5 mm. As a structure capable of increasing a rigidness rather than that of a flat plate, as to a horizontal sectional shape of this supporting portion 10*b*, an open portion thereof is formed in a "U-shape" as represented in FIG. 12A toward the compressing unit 3, and is fastened to the fixing portion 10*a* by a bolt 122. An upper edge portion of the supporting portion 10*b* is horizontally bent so as to constitute an upper plate 102. Screw holes are formed in 4 corners of the upper plate 102, and the operation panel 99 is fixed on the upper plate 102 of the frame 90 by a screw 98 shown in FIG. 8 to FIG. 10.

While the main body cover 8 is made of an insulating resin, or the like, the main body cover 8 covers the entire structural elements of the air compressor 1, more specifically, covers the motor unit 2, the compressing unit 3, the cooling fans 11 and 12, the control circuit unit 5, and the like in order to avoid that an operator directly contacts such units heated by operations, namely, moving units and a power supply unit. Also, the main body cover 8 constitutes such an air duct which cools the motor unit 2 and the compressing unit 3 in a higher efficiency by supplying wind blown from the cooling fans 11 and 12.

As shown in FIG. 9, a concave portion 112 having an opening 11*a* is formed at a portion of an inner plane of the main body cover 8, which is located opposite to the frame 90. A width of the concave portion 112 is made slightly narrower than a width dimension "W" of the supporting portion 10*b* of the frame 90. Under such a condition that the main body cover 8 is mounted on the frame 90 made of a metal material, the concave portion 112 is enlargedly opened in such a manner that the concave unit 112 is closely fitted due to elastical characteristics thereof rather than the width dimension "W" of the frame 90. As a consequence, the upper plane of the main body cover 8 is fixed on the frame 90 by the concave unit 112. Furthermore, the main body cover 8 is mounted in such a manner that the operation panel 99 is exposed from the opening 11*a* formed in the concave unit 112, so that the operator can manipulate the operation panel 99.

Also, a side plane of the main body cover 8 is fixed on projection portions 18*a* and 18*b* of the couplers 6 by screws 113*a* and 113*b*. A front plane and a rear plane of the main body cover 8 are fixed on frames 13*a* and 13*b* by screws 113*c* and 113*d*. These frames 13*a* and 13*b* are welded and fixed on front and rear portions of the air tanks 4*a* and 4*b*.

Next, a description is made of operations of the air compressor 1 equipped with the above-described structure.

(Normal Operation)

When the ON/OFF switch 91 provided on the operation panel 99 is turned ON, electric power of the power supply is supplied to the control circuit unit 5, and then, the control circuit unit 5 starts an inverter control mode so as to commence a supply of electric power to the motor unit 2. As a result, the motor unit 2 is rotated, so that the compressing unit 3 is operated by driving the motor unit 2. Since the compressing unit 3 is operated in connection with the driving operation of the motor unit 2, the piston and the valve provided inside the compressing unit 3 are interlocked so as to suck outside air and compress the sucked outside air, and then, the compressed air is stored in the air tank 4. The pressure of this stored compressed air is reduced to predetermined pressure by the pressure reducing valve, if necessary, and then, the pressure-reduced compressed air is supplied from the couplers 6 to a pneumatic tool so as to constitute power capable of driving, for example, nails and screws.

If pressure detected by the pressure sensor 97 becomes higher than first reference pressure (stopping pressure), then the control circuit unit 5 stops the supply of the electric power to the motor unit 2 and the compressing unit 3 also stops to produce the compressed air. The first reference pressure is previously determined as a predetermined air amount for storing compressed air in the air tank 4.

When the compressed air is consumed by the pneumatic tool, and then, pressure within the air tank 4 detected by the pressure sensor 97 becomes lower than a second reference value (re-initiating pressure) which is lower than the first reference value, the control circuit unit 5 initiates the motor unit 2 so as to restart a production of compressed air. While the motor unit 2 is rotated, the cooling fans 11 and 12 coupled to the rotation shaft of the motor unit 2 are also rotated, so that the cooling fans 11 and 12 supply cooling wind to the air duct formed by the main body cover 8 so as to cool the heat generating portions such as the control circuit unit 5, the motor unit 2, the compressing unit 3, and the like.

The control circuit unit 5 is operated in accordance with the operation program previously stored in the storage element so as to execute the below-mentioned control operations i), ii), and iii). In the control operation i), the control circuit unit 5 drives the motor unit 2 in the inverter control mode in accordance with a detection value of the pressure sensor 97 and a setting value set by operating the operation panel 99. In the control operation ii), the control circuit unit 5 updates the setting value in accordance with the operation of the operation panel 99. In the control operation iii), the control circuit unit 5 judges an operating condition of the air compressor 1 based upon detection outputs as to various sorts of sensors (power supply voltage sensor, temperature sensor, and the like, which are not shown), an operation history, and the like. Then, the control circuit unit 5 displays the judged operation condition on the display unit 96 of the operation panel 99, for instance, displays whether the judged operation condition is a normal condition, or an abnormal condition. Also, the control circuit unit 5 causes a buzzer 97 to output an alarm sound in order to notify the abnormal condition to the operator. Further, the control circuit unit 5 performs such a necessary process operation that the supply of the electric power to the motor unit 2 is stopped, if necessary.

While the operation panel 99 is connected via a cable, a connector, and the like to the control circuit unit 5, the operation panel 99 supplies instructions and input data produced by the operator to the control circuit unit 5 in response to operations of the respective switches. Also, in response to instructions issued from the control circuit unit 5, the operation panel 99 performs arbitrary display operation on the display unit 96, or causes the buzzer 97 to output various sorts of notification sounds. When the ON/OFF switch 91 provided on the operation panel 99 is turned OFF, the supply of the power supply power to the control circuit unit 5 is stopped, and the operation of the control circuit unit 5 is also stopped, so that the entire operation of the air compressor 1 is stopped.

Under operating condition, various types of vibrations may be produced, since the motor unit 2 is rotated; the piston provided in the compressing unit 3 is actuated; the cooling fans 11 and 12 are rotated; and also, the cooling wind is blown. Under such an operating condition, the operation panel 99 is fixed on the frame 90. Since the fixing portion 1*a* of the frame 90 is tightly fixed on the air tanks 4*a* and 4*b* by being welded, the frame 90 has constructed the frame having the rigidness as the entire structural portion. As a result, the upper plate 102 of the frame 90 may suppress vibrations thereof. As a consequence, vibrations of the operation panel 99 fixed on this upper plate 102 by the screw 98 may also be reduced. Accordingly, vibrations of connection portions between the operation panel 99 and the signal lines for connecting the operation panel 99 to the control circuit unit 5 can also be reduced, and disconnections of the signal lines can hardly occur, so that the aging effect may be relatively decreased and the reliability may be increased. Also, since the vibrations may be suppressed, the buttons and the switches of the operation panel 99 can be easily manipulated, and the displayed contents of the display unit 96 may be readily viewed.

Moreover, the concave portion 112 of the main body cover 8 molded by employing the synthetic resin is fitted to the frame 90. As a consequence, the vibrations of the main body cover 8 may also be suppressed, and thus, the noise may be suppressed.

(Setting Operation)

The above-described first reference pressure and second reference pressure are properly set in response to a necessity of an operator. For example, in such a case that a used amount of compressed air is large, the second reference pressure (re-initiating pressure) is set to be high, and a spare of the compressed air is prepared. To the contrary, in such a case that a used amount of compressed air is small, the second reference pressure (re-initiating pressure) is set to be relatively low so as to suppress useless driving operation.

When the operator changes a setting value of re-initiating pressure, for example, the operator manipulates the mode selecting switch 92 of the operation panel 99 so as to select such a mode "setting of re-initiating pressure", and then, manipulates both the UP switch 93 and the DOWN switch 94 in order to change the setting value. While the above-described setting operation is carried out by the operator, for instance, the control circuit unit 5 displays the setting value on the display unit 96.

When the operator manipulates the decision switch 95, the control circuit unit 5 acquires as the second reference pressure (re-initiating pressure), such a pressure value being displayed on the display unit 96 at this time, and then, stores the acquired pressure value in the storage element. Subsequently, the control circuit unit 5 is operated in accordance with the newly stored second reference value.

(Manufacture and Maintenance)

When the air compressor 1 having the above-described structure is manufactured, the operation panel 99 is arranged under such a condition that the frame 90 is mounted, and necessary wiring lines are applied. Thereafter, the upper plane of the main body cover 8 is fixed on the frame 90 in such a manner that the concave portion 112 of the main body cover 8 is forced to be inserted into the frame 90. Furthermore, the side plane of the main body cover 8 is fixed on the projection portions 18*a* and 18*b* of the couplers 6 by employing the screws 113*a* and 113*b*. Both the front plane and the rear plane of the main body cover 8 are fixed on the frames 13*a* and 13*b* by employing the screws 113*c* and 113*d*, which are fixed by the welding process on the front and rear portions of the air tank 4. The main body cover 8 is mounted on the frame 90 in accordance with the above-explained manner. When the maintenance of the air compressor 1 is performed, the main body cover 8 can be dismounted without giving an adverse influence to both the power supply cable 901 connected between the operation panel 99 and the power supply cord 50, and the signal cable 902 connected between the operation panel 999 and the control circuit unit 5.

Alternatively, fastening of the screw 98 may be released from the operation panel 999 without disconnecting the main body cover 8 so as to check the air compressor 1 as an element. As one example of structures capable of realizing the alternative checking method, a diameter of an opening 11*a* is made large by which fastening of the screw 98 can be essentially released, and furthermore, a through hole is formed in the upper plate 102 of the frame 90. Since the above-described alternative structure is employed, the operation panel 999 may be separated from the frame 90 under such a condition that the main body cover 8 is fitted to the frame 90, and furthermore, the operator may perform maintenance of the air compressor 1 by touching the power supply cable 901, the signal cable 902, and the like from the through hole.

As previously described, in accordance with the air compressor 1 related to the fourth embodiment mode, the frame 90 corresponding to the rigid body made of the metal and the like is arranged on the air tanks 4*a* and 4*b* corresponding to the rigid body, and the operation panel 999 is arranged on the rigid frame 90, so that the vibration levels of the operation panel 999 can be reduced so as to suppress the deteriorations in the connection portions of the wires and the cables with respect to the operation panel 99, and thus, the reliability of the air compressor 1 can be increased.

Also, since the vibrations of the operation panel 99 can be suppressed, the operating condition can be easily confirmed and the setting operations set by manipulating the switches thereof can be easily carried out.

Also, since the concave portion 112 of the main body cover 8 is forced to be inserted in the frame 90 so as to be fitted to this frame 90, the vibrations and noises of the main body cover 8 can also be suppressed.

In addition, since the main body cover 8 and the operation panel 99 are arranged in the separate bodies, the disconnections and the contact failures as to the power supply cable 901, the signal cable 902, and the connectors when the air compressor 1 is assembled can be confirmed before the main body cover 8 is mounted on the main body of the air compressor 1, so that the high-volume production capability and the reliability can be improved. Moreover, since the cable has not been connected to the main body cover 8, the main body cover 8 can be readily dismounted, so that various sorts of maintenance works can be carried out in a higher efficiency.

Figure 12C:
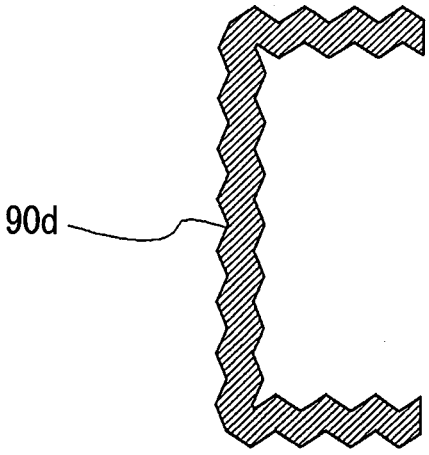

In the fourth embodiment mode, the following explanation is made: That is, as the structure of the frame 90 capable of increasing the rigidness rather than that of a flat plate, the horizontal sectional plane of the frame 90 is formed as a so-called "U-shaped" form, as shown in FIG. 12A. Alternatively, as represented in FIG. 12A and FIG. 12C respectively, frame structures may be realized as a triangle-shaped frame 90*c* and a "U-shaped" as well as "wave-shaped" frame 90*d*. Furthermore, a flat plate may be merely employed as the above-described frame 90 if a material of this flat plate may have a sufficiently high rigidness capable of suppressing the vibrations of this flat plate.

Figure 13:
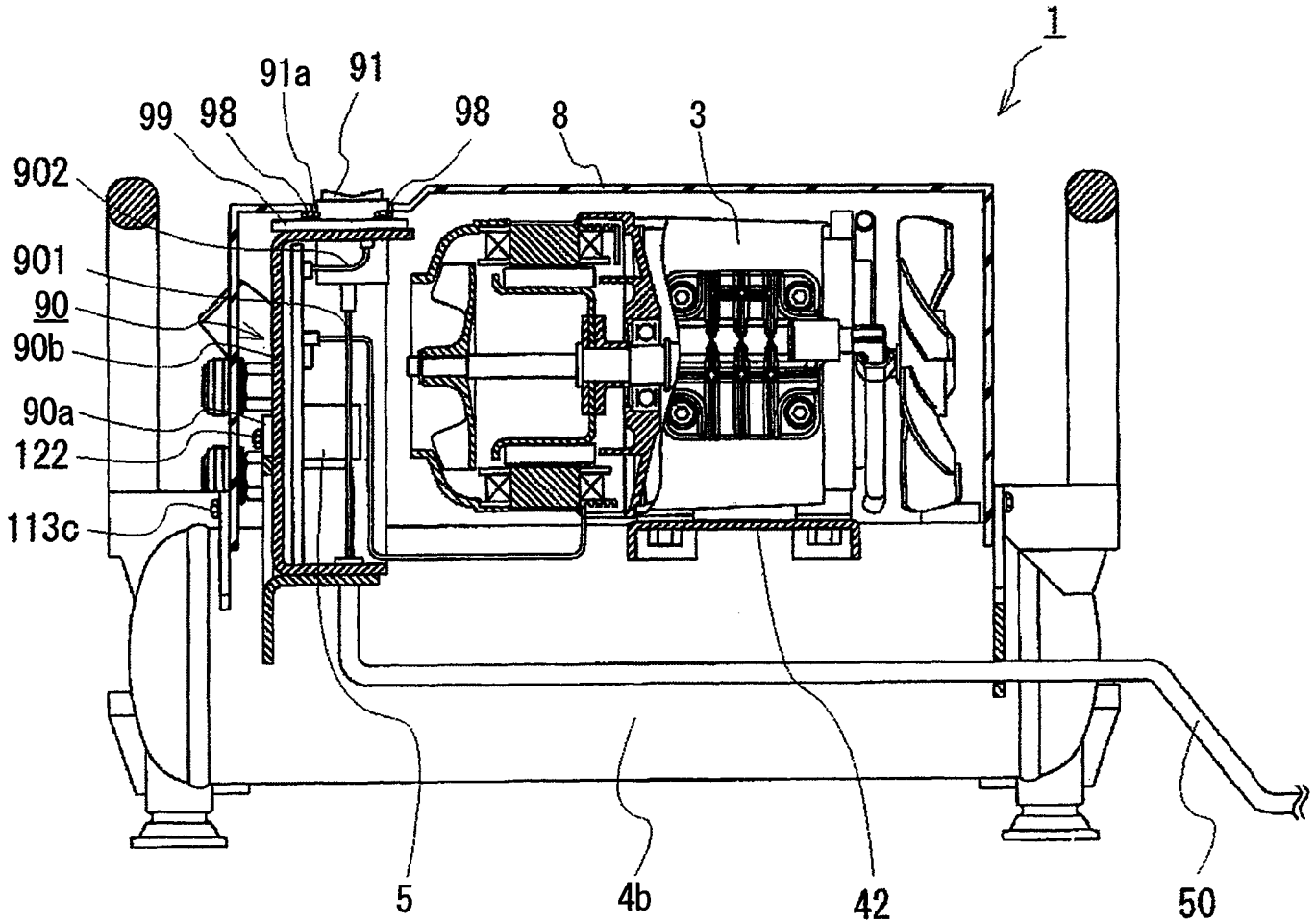
FIG. 13 is a side view (partially sectional view) for showing an air compressor according to a fifth embodiment mode of the present invention.
Figure 14:
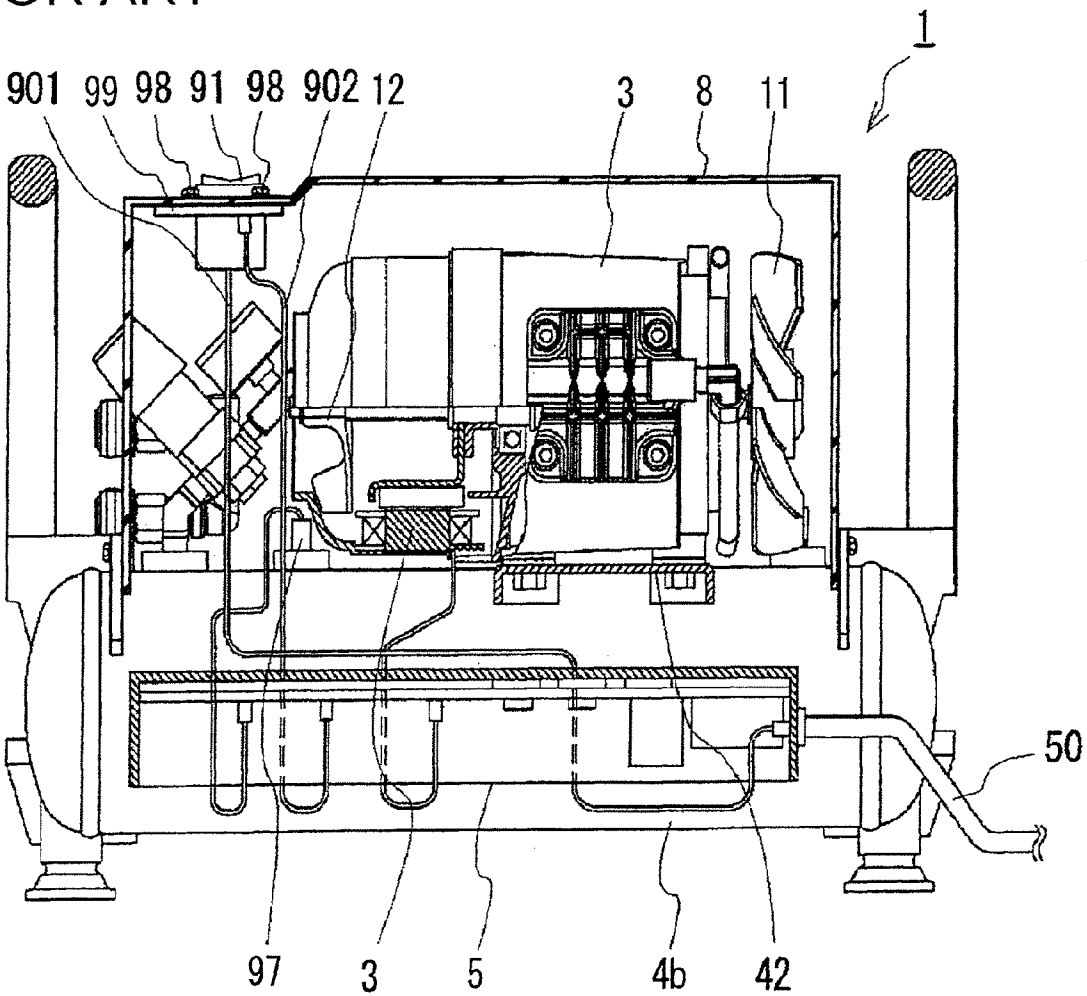
FIG. 14 PRIOR ART
FIG. 14 is a side view (partially sectional view) for indicating the conventional air compressor.

In the above-described fourth embodiment mode, the control circuit unit 5 was arranged on the horizontal frame. However, if this arrangement is employed, then the lengths of the cables 901, 902, and the like, which connect the operation panel 99 to the control circuit unit 5 become relatively long. As a result, there are some possibilities that a noise induction problem may occur. To solve this problem, for instance, as indicated in FIG. 13, the control circuit unit 5 may be arranged on the frame 90 according to a fifth embodiment mode.

In accordance with this structure, a length of a signal cable 902 connected between the control circuit unit 5 and the operation panel 99 to be mounted on the frame 90 can be shortened. Generally speaking, there are many cases that a total number of wiring lines connected between the control circuit unit 5 and the operation panel 99 is larger than that of a power supply line, and the like, and moreover, diameters of these wiring lines are made smaller than that of the power supply line. As a result, there are some possibilities that disconnections of the narrow wiring lines may easily occur. However, in accordance with the fifth embodiment mode, since the length of this signal line (signal cable 902) may be made short, stresses applied to the signal line and the connection portions (connectors and soldered portions) may become small. As a result, disconnections of the signal line can hardly occur and the reliability thereof can be increased. Also, since the short signal line can be hardly and adversely influenced by disturbance noise, the reliability may be increased. Moreover, similar to the fourth embodiment mode, the superior vibration and operable characteristics can be maintained.

While the fourth and fifth embodiment modes of the present invention have been described, the present invention is not limited only to the above-described embodiment modes, but may be modified and changed in various manners.

For instance, if the structure of the frame 90 can distribute the suppression of the vibrations as to the operation panel 99 and the main body cover 8, then any types of structures may be arbitrarily employed. For example, in the above-described example, such a structure is exemplified that the frame 90 is separated to both the fixing portion 10*a* and the supporting portion 10*b*. If such a separation structure is employed, then the frame 90 can be easily fixed (welded) on the air tanks 4*a* and 4*b*, as compared with that of such a case that the entire frame 90 is formed as one integral body. However, the present invention is not limited only to this structure, for example, the entire structure of the frame 90 may be alternatively formed as one integral body. Also, the structure of the frame portion where the operation panel 99 is mounted may be arbitrarily selected. For instance, upper edge portions of both side plates of the frame 90 may be alternatively bent along the horizontal direction, and then, the operation panel 99 may be alternatively fixed on the bent upper edge portions.

In addition, such a structure that the operation panel 39 is horizontally fixed is exemplified. However, there is no problem if the operation panel 99 is separated from the main body cover 8 and is fixed on the frame 90. Therefore, directions and inclinations of the operation panel 99 may be arbitrarily selected. Also, sizes, materials, and shapes as to the operation panel 99 may be arbitrarily selected. Further, sorts, quantities, and contents as to switches and elements which are arranged on the operation panel 99 may be arbitrarily, selected.

Also, such an example that the control circuit unit 5 drives the motor unit 2 in the inverter drive mode is exemplified. Alternatively, if the rotation number of the motor unit 2 may be properly controlled, then any other circuit arrangements and driving methods may be alternatively employed. Furthermore, the control circuit unit 5 may be alternatively separated into the power supply portion, the control portion, the drive portion of the motor unit 2, and the like, and thereafter, these separated portions may be alternatively arranged in a separation manner.

In the above-described fourth and fifth embodiment modes, since the upper edge portions of the frame 90 are forced to be inserted into the concave portion 112 of the main body cover 8 so as to be fitted to this concave portion 112, the frame 90 is contacted and supported by at least one portion of the main body cover 8. However, methods for contacting and supporting the main body cover 8 may be alternatively determined. For example, alternatively, an insertion-purpose opening portion may be formed in the frame 90; the convex portion formed on the inner plane of the main body cover 8 may be forced to be inserted into the insertion-purpose opening portion; a supporting portion for supporting the inner plane of the main body cover 8 may be formed on the frame 90; a screw hole may be formed in this supporting portion; and then, the upper plane portion of the main body cover 8 may be fixed on the frame 90 by fastening a screw via the screw hole. In this alternative case, it is desirable that the main body cover 8 is elastically deformed to be fixed thereon in such a manner that vibrations may be suppressed.

In the above-described fourth and fifth embodiment modes, the pressure sensor 97 was arranged in the air tank 4*b*. Alternatively, arranging positions as to the pressure sensor 97 may be arbitrarily selected if pressure within the air tank 4 may be detected.

What is claimed is:

1. An air compressor comprising:

a main body cover having a front plane and a rear plane;

a pair of air tanks for storing compressed air extending along each other;

a compressing unit that compresses air sucked from an external space so as to supply the compressed air to the air tanks;

a motor coupled to the compressing unit so as to drive the compressing unit, wherein the motor and the compressing unit are arranged above the pair of air tanks;

a control circuit unit that includes a semiconductor switching element for controlling driving operation of the motor arranged above the pair of air tanks, the semiconductor switching element generates heat when the semiconductor switching element controls the driving operation of the motor, the control circuit unit contains a storage case for storing a circuit board therein;

a first cooling fan that generates a first air flow, wherein the first cooling fan is provided on one end of a rotation shaft of the motor and is disposed between the control circuit unit and the motor along an axial direction of the motor; and a second cooling fan that generates a second air flow, wherein the second cooling fan is provided on the other end of the rotation shaft of the motor, wherein the motor, the first cooling fan and the control circuit unit are disposed in the main body cover and the control circuit unit is placed between a wall portion of the main body cover having a wind window and the first cooling fan so that either a portion or an overall portion of the storage case is positioned to overlap with an axial direction projection area of the first cooling fan, wherein a semi-spherical and cylindrical-shaped fan guide is provided on one end side of a housing of the motor, and the fan guide is located outside the first cooling fan and guides the air flow of the first cooling fan to a stator coil portion, wherein the first air flow is sucked into an interior portion of the main body cover and the fan guide via the front plane and is exhausted from a side portion of the motor by the fan guide, and wherein the second air flow is exhausted from inside the main body cover to the external space via the rear plane of the main body cover.

2. The air compressor according to claim 1, wherein the storage case is arranged along a longitudinal direction in order that the storage case is located opposite to the first cooling fan.

3. The air compressor according to claim 2, wherein the storage case is formed in a rectangular parallelepiped, at least one plane of which is opened, and wherein the opened plane is arranged to be directed to the first cooling fan.

4. The air compressor according to claim 1, wherein a diameter of an air sucking port of the fan guide is smaller than a width of an opened plane of the storage case.

5. The air compressor according to claim 4, wherein the first cooling fan is a centrifugal fan.

6. The air compressor according to claim 1, wherein an air ejecting port is provided in an outer circumferential portion of the fan guide, the air ejecting port exhausts a portion of the first air flow to the external space without directing the portion of the first air flow to the stator coil portion of the motor.

7. The air compressor according to claim 1, wherein the first air flow generated by the first cooling fan is sucked from the wind window, the first air flow passes through an interior portion of the motor, and then the first air flow is exhausted from another wind window of the main body cover.

8. The air compressor according to claim 1, further comprising:

a switch interlocked with the control circuit unit, wherein the main body cover covers the compressing unit and the motor, and wherein a frame is fixed on the pair of air tanks, and the switch is fixed on the frame.

9. The air compressor according to claim 8, wherein the frame is arranged in such a manner that at least one portion of the frame is contacted to the main body cover.

10. The air compressor according to claim 8, wherein the main body cover is fitted into the frame, or fixed on the frame.

11. The air compressor according to claim 8, wherein the frame has a rigidness, the frame is raised on the pair of air tanks.

12. The air compressor according to claim 8, wherein the frame is made of a metal.

13. The air compressor according to claim 8, wherein the control circuit unit includes an inverter control apparatus and a operation condition detecting unit for detecting an operation condition of the motor, and the air compressor further comprises:

a plurality of switches that set and instruct the operation condition of the motor to the inverter control apparatus based upon an output signal of a pressure sensor; and a notifying unit that notifies the operation condition of the motor detected by the operation condition detecting unit.

14. The air compressor according to claim 8, wherein the control circuit unit is arranged on the frame.

15. The air compressor according to claim 1, wherein the control circuit unit comprises a first metal member extending in an axial direction of the motor and a second metal member extending in a direction perpendicular to the axial direction of the motor, wherein the second metal member faces the wall portion of the main body cover having the wind window.

16. The air compressor according to claim 1, wherein the control circuit unit is arranged in the first air flow downstream of the wind window.

17. The air compressor according to claim 1, wherein at least a portion of the semiconductor switching element is positioned to overlap with the axial direction projection area of the first cooling fan.

* * * * *